US006705691B2

(12) United States Patent
Yamane et al.

(10) Patent No.: US 6,705,691 B2
(45) Date of Patent: Mar. 16, 2004

(54) INK-JET PRINTING METHOD AND INK-JET PRINTER

(75) Inventors: Toru Yamane, Kanagawa (JP); Yutaka Koizumi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 09/757,593

(22) Filed: Jan. 11, 2001

(65) Prior Publication Data

US 2001/0008405 A1 Jul. 19, 2001

(30) Foreign Application Priority Data

Jan. 14, 2000 (JP) ..... 2000-006537

(51) Int. Cl.[7] ..... B41J 2/01
(52) U.S. Cl. ..... 347/1; 347/12; 347/9
(58) Field of Search ..... 347/12, 9, 10, 347/11, 13, 42, 4, 182, 1; 271/193; 198/691

(56) References Cited

U.S. PATENT DOCUMENTS

| | | | | |
|---|---|---|---|---|
| 3,740,133 A | * | 6/1973 | Komori et al. | 355/8 |
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,539,569 A | | 9/1985 | Watanabe et al. | 346/140 R |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 4,947,191 A | | 8/1990 | Nozawa et al. | 346/140 R |
| 5,006,867 A | | 4/1991 | Koizumi et al. | 346/140 R |
| 5,066,864 A | * | 11/1991 | Brandner et al. | 346/33 |
| 5,164,747 A | | 11/1992 | Osada et al. | 346/140 R |
| 5,214,450 A | * | 5/1993 | Shimoda | 346/140 |
| 5,343,227 A | | 8/1994 | Hirosawa et al. | 349/42 |
| 5,646,659 A | | 7/1997 | Moriyama et al. | 347/55 |
| 5,682,190 A | | 10/1997 | Hirosawa et al. | 347/94 |
| 5,745,129 A | | 4/1998 | Moriyama et al. | 347/12 |
| 5,748,213 A | | 5/1998 | Karita et al. | 347/63 |

(List continued on next page.)

FOREIGN PATENT DOCUMENTS

| | | |
|---|---|---|
| EP | 0 588 616 A1 | 3/1994 |
| EP | 0 710 560 A2 | 5/1996 |
| EP | 0 757 940 A2 | 2/1997 |
| EP | 0 770 485 A2 | 5/1997 |
| EP | 0 805 027 A2 | 11/1997 |
| JP | 59-123670 | 7/1984 |
| JP | 59-138461 | 8/1984 |
| JP | 2-059349 | 2/1990 |
| JP | 4-083644 | 3/1992 |
| JP | 06-006357 | 1/1994 |
| JP | 9-300621 | 11/1997 |
| JP | 10-086376 | 4/1998 |
| JP | 10-202851 | 8/1998 |

*Primary Examiner*—Benjamin R. Fuller
*Assistant Examiner*—Lam Nguyen
(74) *Attorney, Agent, or Firm*—Fitzpatrick, Cella, Harper & Scinto

(57) ABSTRACT

In an ink-jet printing method and ink-jet printer for printing an image on a printing medium by driving print elements of a printhead and ejecting ink in accordance with an image signal, the timing of driving the plurality of print elements of the printhead is divided into a plurality of timings, and print elements, of the plurality of print elements, which are spaced apart from each other by a predetermined distance are selected as one group at each of the plurality of timings. The print elements belonging to the selected group are energized and driven. The dispersed print elements are changed a predetermined period of time after the driving, and the changed print elements are driven. This driving operation is repeatedly executed for all the print elements of the printhead to print an image corresponding to the image signal.

10 Claims, 21 Drawing Sheets

U.S. PATENT DOCUMENTS

| | | | | |
|---|---|---|---|---|
| 5,826,333 | A | | 10/1998 | Iketani et al. ..... 29/890.1 |
| 5,867,200 | A | | 2/1999 | Tajima et al. ..... 347/211 |
| 5,916,452 | A | | 6/1999 | Kobayashi et al. ..... 216/27 |
| 5,933,163 | A | | 8/1999 | Koizumi et al. ..... 347/42 |
| 5,940,957 | A | | 8/1999 | Goto et al. ..... 29/611 |
| 6,024,439 | A | | 2/2000 | Sueoka et al. ..... 347/50 |
| 6,062,675 | A | | 5/2000 | Hirosawa et al. ..... 347/50 |
| 6,084,611 | A | | 7/2000 | Yamane et al. ..... 347/50 |
| 6,113,214 | A | | 9/2000 | Hirosawa et al. ..... 347/42 |
| 6,116,714 | A | | 9/2000 | Imanaka et al. ..... 347/19 |
| 6,168,254 | B1 | | 1/2001 | Karita et al. ..... 347/20 |
| 6,309,064 | B1 | * | 10/2001 | Tanno et al. ..... 347/104 |
| 6,375,184 | B1 | * | 4/2002 | Hayashi ..... 271/18.1 |

* cited by examiner

FIG. 18

DISTANCE BETWEEN ADJACENT NOZZLES THAT ARE SIMULTANEOUSLY DRIVEN AND IMAGE QUALITY

| DISTANCE BETWEEN ADJACENT NOZZLES [μm] | 63.5 | 127 | 190.5 | 254 | 317.5 |
|---|---|---|---|---|---|
| 2000V | × | × | × | ○ | ○ |
| 1500V | × | × | × | ○ | ○ |
| 1000V | × | ○ | ○ | ○ | ○ |

FIG. 20

| DISTANCE BETWEEN ADJACENT NOZZLES [μm] | APPLIED VOLTAGE [kV] | DISTANCE BETWEEN DOTS [μm] | | | | | | | | | | | LANDING POSITION OFFSET [μm] | IMAGE QUALITY EVALUATION |
|---|---|---|---|---|---|---|---|---|---|---|---|---|---|---|
| | | 1 | 2 | 3 | 4 | 5 | 6 | 7 | 8 | 9 | 10 | AVERAGE | | |
| 140 | 0 | 149 | 150 | 143 | 139 | 147 | 147 | 146 | 157 | 157 | 143 | 147.8 | 7.8 | ○ |
| | 2 | 183 | 175 | 177 | 182 | 184 | 174 | 185 | 187 | 184 | 195 | 182.6 | 42.6 | × |
| | 3 | 232 | 230 | 224 | 224 | 237 | 237 | 233 | 231 | 227 | 228 | 230.3 | 90.3 | × |
| 280 | 0 | 291 | 285 | 290 | 285 | 285 | 275 | 284 | 286 | 270 | 272 | 282.3 | 2.3 | ○ |
| | 2 | 295 | 291 | 290 | 296 | 301 | 288 | 296 | 288 | 298 | 301 | 294.4 | 14.4 | ○ |
| | 3 | 290 | 277 | 283 | 281 | 288 | 289 | 281 | 287 | 288 | 283 | 284.7 | 4.7 | ○ |
| 420 | 0 | 419 | 427 | 421 | 414 | 433 | 427 | 428 | 420 | 416 | 426 | 423.1 | 3.1 | ○ |
| | 2 | 423 | 430 | 426 | 430 | 431 | 425 | 416 | 428 | 425 | 422 | 425.6 | 5.6 | ○ |
| | 3 | 426 | 422 | 424 | 433 | 425 | 427 | 428 | 434 | 431 | 428 | 427.8 | 7.8 | ○ |

INK-JET PRINTING METHOD AND INK-JET PRINTER

FIELD OF THE INVENTION

The present invention relates to an ink-jet printing method and ink-jet printer for printing an image on a printing medium by driving print elements of a printhead and ejecting ink in accordance with an image signal.

BACKGROUND OF THE INVENTION

Conventionally, as printers for printing images on printing media (to be referred to as printing sheets hereinafter) by selectively driving print elements in accordance with print signals input from external devices such as host computers, printers based on the wire dot scheme, thermal transfer scheme, ink-jet schemes, and the like are known. Of these printers, an ink-jet printer, which incorporates an ink-jet printhead to print images by discharging ink from orifices (nozzles) of the printhead, can print high-resolution images, and is inexpensive. Owing to these advantages, this printer has recently attracted a great deal of attention, and is increasingly used in various fields. There is increasing demand for an ink-jet printer for color printing or gray-scale printing, in which a plurality of printheads, each having a plurality of ink channels and print elements with discharge energy generating elements arrayed at a fine pitch, are arranged in a direction (main scanning direction) perpendicular to the array direction (sub-scanning direction) of the plurality of print elements, and an image is printed by scanning these printheads in the main scanning direction.

In the above printhead, heating resistors serving as discharge energy generating elements are arranged at positions corresponding to the respective nozzles, and heat energy is generated by flowing a current in heating resistors. A liquid is then discharged from the corresponding nozzles by using the heat energy, thereby printing an image. Since today's demands for high-density, high-speed printing are especially high, a plurality of lines are generally printed by one scanning operation of the printhead in the main scanning direction. Therefore, a printhead having many heating elements arranged at a high density is used.

When high-density, high-speed printing is performed, neighboring nozzles of the printhead are driven at very short time intervals. For this reason, ink discharged from a given nozzle tends to be influenced by a pressure wave produced by ink discharged from adjacent nozzles. Consequently, the amount, discharge speed, and the like of ink discharged from the respective nozzles become unstable, resulting in a deterioration in the quality of printed images.

In addition, if a printing sheet is checked by an electrostatic chuck method in conveying the printing sheet, ink droplets flying from the printhead are charged before they reach the printing sheet, as shown in FIG. 12. As a consequence, ink droplets flying nearby repel each other and their flying directions interfere with each other. As a result, the landing position of each ink droplet on the printing sheet deviates from the correct position. This will degrade the quality of an image printed on the printing sheet, thus posing a serious problem.

SUMMARY OF THE INVENTION

The present invention has been made in consideration of the above prior art, and has as its object to provide an ink-jet printing method and ink-jet printer which can print a high-quality image by eliminating the mutual influences of neighboring print elements, which is occurred in an apparatus for conveying a recording sheet by using an electrostatic chuck method.

It is another object of the present invention to provide an ink-jet printing method and ink-jet printer which can print a high-quality image by eliminating the influences of ink droplets discharged from neighboring print elements (nozzles).

It is still another object of the present invention to provide an ink-jet printing method and ink-jet printer which eliminate the influences of ink droplets discharged from neighboring print elements (nozzles) and increase the capacity of a power supply for driving a printhead.

It is still another object of the present invention to provide an ink-jet printing method and ink-jet printer in which the print elements of a printhead are formed into a plurality of groups, and the groups are time-divisionally driven, thereby eliminating, at the current driving timing, the influences of pressure waves generated by print elements which discharged ink at a driving timing preceding the current driving timing.

It is still another object of the present invention to provide an ink-jet printing method and ink-jet printer which can print a high-quality image by eliminating the influences of ink droplets discharged from neighboring print elements (nozzles) even when a printing medium is conveyed by the electrostatic chuck method.

In order to attain the above described objects, an ink-jet printer of the present invention prints an image on a printing medium by driving print elements of a printhead and ejecting ink in accordance with an image signal. The printer comprises: division means for dividing a timing of driving a plurality of print elements of the printhead in accordance with an image signal into a plurality of driving timings; selection means for selecting one of print element groups, of a plurality of print elements of the printhead, which are spaced apart from each other at predetermined intervals corresponding to the number of driving timings; driving means for energizing and driving the print element group selected by the selection means in accordance with the image signal at one of the plurality of driving timings; driving control means for causing the selection means to select a next print element group by shifting a position of the print element selected by the selection means by a predetermined amount, after driving is performed by said driving means, and causing the driving means to drive the print element group; and control means for causing the driving control means to repeatedly drive until a plurality of print elements of the printhead are selected by said selection means and driven at the plurality of driving timings.

An ink-jet recording apparatus of the present invention records an image on a recording medium by driving recording elements of a recording head and ejecting ink in accordance with an image signal. The apparatus comprises: conveyance means for conveying the recording medium by an electrostatic chuck method; and selection means for selecting recording elements which are separately located from each other among a plurality of recording elements of the recording head, as a group, that are substantially simultaneously driven; wherein the selection means selects the recording elements which are separated, such that a deterioration in image quality due to a landing position offset by an electrostatic power from said conveyance means can be suppressed.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

FIGS. 15A to 15C are views for explaining the ink-jet printhead according to the embodiment of the present invention, in which FIG. 15A is a schematic plan view of the printhead, FIG. 15B is a sectional view taken along a line A—A in FIG. 15A, and FIG. 15C is a sectional view taken along a line B—B in FIG. 15A;

FIGS. 18–21 show views for explaining a relationship between a surface potential of sheet and variances of ink-jetted positions.

DETAILED DESCRIPTION OF THE PREFERRED EMBODIMENT

Preferred embodiments of the present invention will be described in detail below with reference to the accompanying drawings.

[First Embodiment]

Figure 1A:
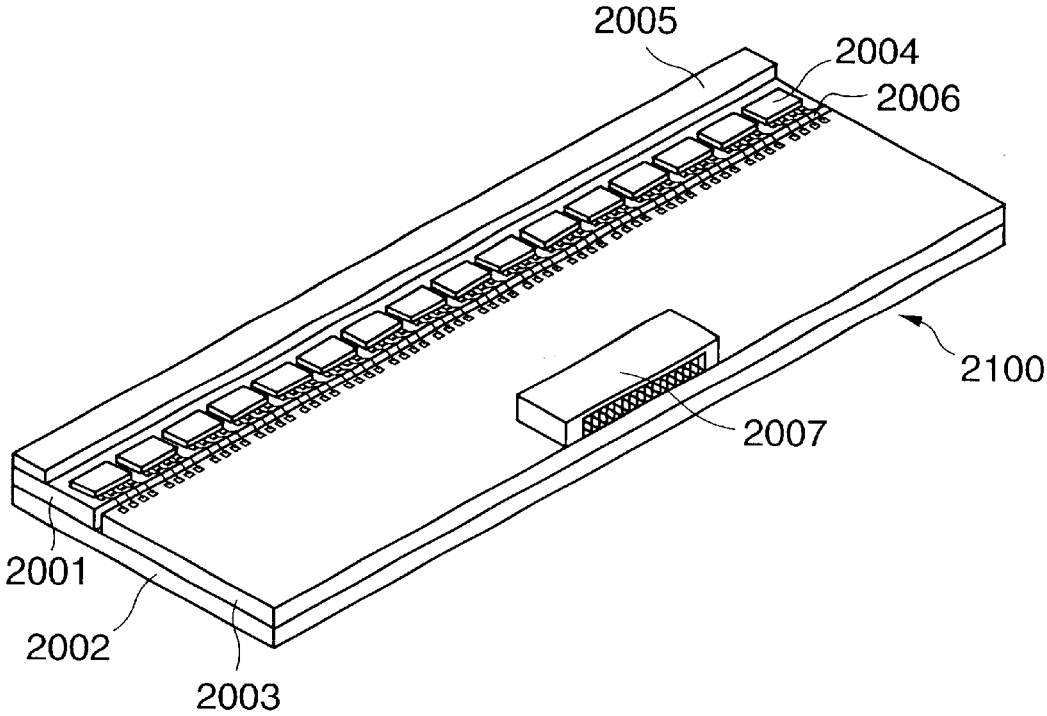
FIG. 1A is a perspective view showing a printhead unit according to an embodiment of the present invention.
Figure 1B:
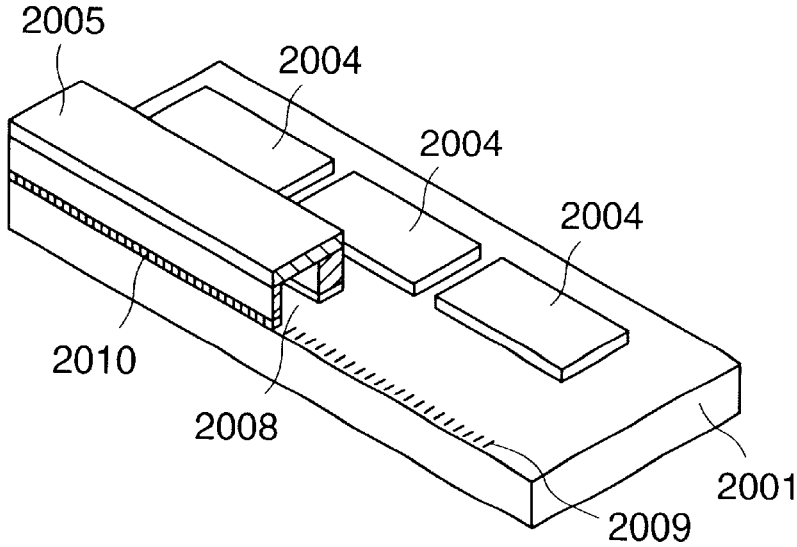
FIG. 1B is an enlarged sectional perspective view of a printhead portion of the unit.

FIG. 1A is a perspective view of a full-line type printhead unit 2100 according to the first embodiment of the printhead. FIG. 1B is an enlarged sectional perspective view of a printhead portion of this embodiment.

Referring to FIGS. 1A and 1B, heat energy generating elements (heating resistors) 2009 are arranged on a print element board 2001, and nozzles (ink orifices: print elements) and a ceiling plate 2005 forming an ink chamber 2008 are arranged on the heat energy generating elements 2009. In addition, driving elements 2004 for driving the heat energy generating elements 2009 are mounted on the print element board 2001. The driving elements 2004 supply electric energy to the heat energy generating elements 2009 via an interconnection pattern (not shown) formed on the print element board 2001. The printhead having this arrangement is fixed on a base plate 2002, together with a printed board 2003. In this case, the printhead and printed board 2003 are electrically connected to each other via bonding wires 2006. An electric connector 2007 for inputting external electrical signals is mounted on the printed board 2003. Ink used for printing is supplied into the ink chamber 2008 via an ink tank and ink supply tube (not shown). In printing, driving signals corresponding to print signals input through the electric connector 2007 are sent to the driving elements 2004 via the bonding wires 2006. As a consequence, the heat energy generating elements 2009 are driven by electrical pulse signals output from the driving elements 2004. Bubbles are then formed in the ink in the nozzles 2010, and ink droplets are discharged from ink 2010.

Figure 2:
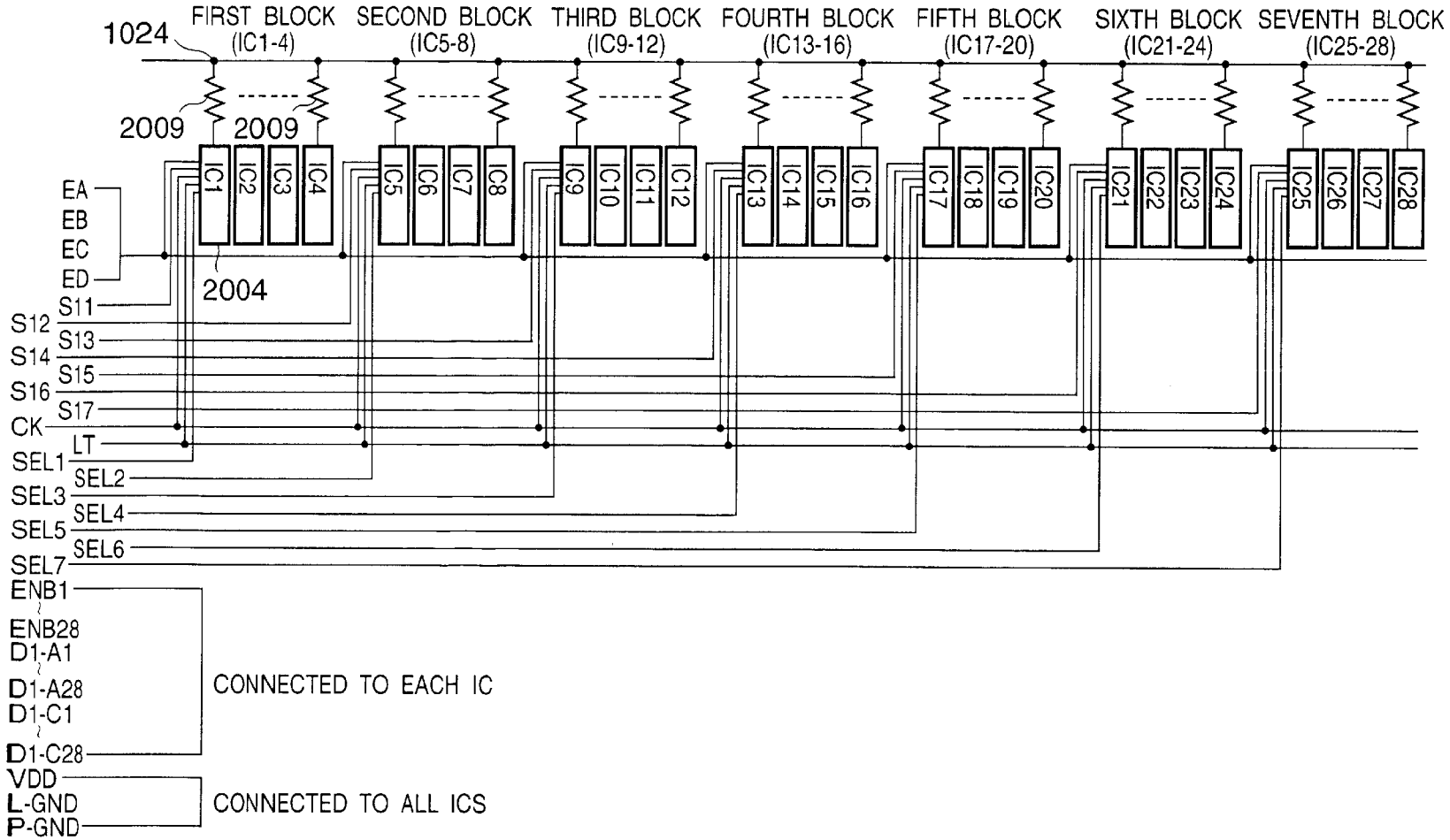
FIG. 2 is a circuit diagram of a driving circuit for the printhead according to this embodiment of the present invention.

FIG. 2 is a view showing the circuit wiring of the printhead unit 2100 according to this embodiment.

In this embodiment, 28 driving elements 2004 (IC1 to IC28) are used, and 256 heat energy generating elements 2009 are driven by one driving element 2004. These 28 driving elements 2004 are grouped into a total of seven blocks each consisting of four driving elements (ICi to ICi+3). Print data signals (SI1 to SI7), a data signal transfer clock (CK), a latch signal (LT), and signals EA, EB, EC, and EG (to be described later) are input to each block. Signals (SEL1 to SEL7) for chip-enabling the driving elements 2004 belonging to the respective blocks are respectively input to the blocks. Signals (ENB1 to ENB28) for determining the pulse widths of electrical pulses for driving the heat energy generating elements 2009, signals D1-A1 to D1-A28 and D1-C1 to D1-C28, and power supply lines VDD, L-GND, and P-GND are input to each driving element 2004 via the corresponding interconnections (not shown).

Figure 3:
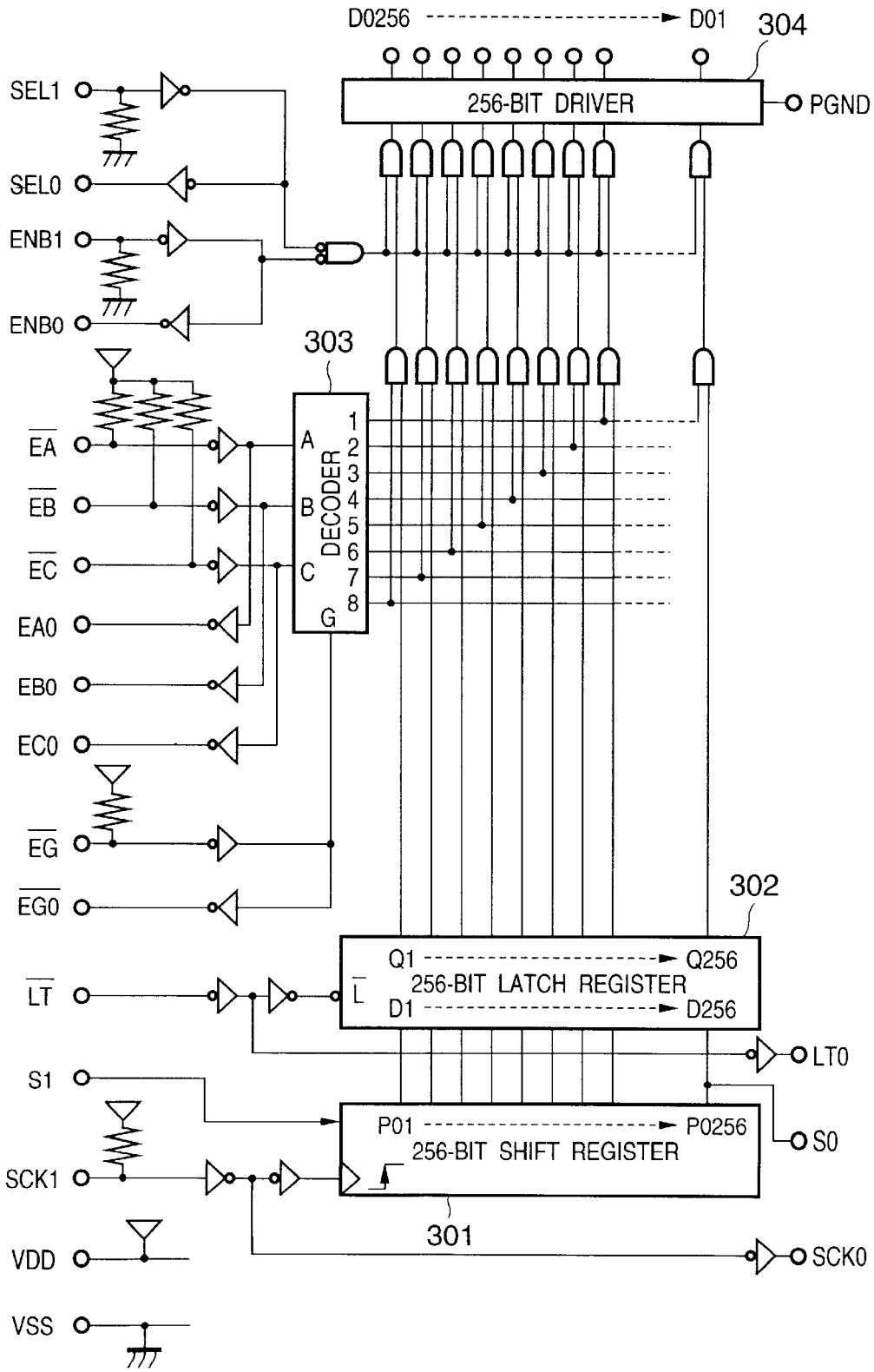
FIG. 3 is a circuit diagram of a driving element according to this embodiment of the present invention.

FIG. 3 is a block diagram showing the arrangement of each driving element 2004 in this embodiment.

A data signal (SI) is sequentially transferred and stored in a 256-bit shift register 301 in synchronism with a data transfer clock (SCKI: CK in FIG. 2). The 256-bit data stored in the shift register 301 is sent to a 256-bit latch register 302 and stored therein in accordance with a latch signal (LT*: "*" indicating a negative-logic signal). All signals EA*, EB*, EC*, and EG* are negative-logic (low true) signals, which are input to a 3–8 decoder 303 to perform distributed driving eight times. The signals stored in the latch register 302 are selectively output to a driver 304 in units of eight blocks. Each signal selected in this manner drives a transistor corresponding to the heat energy generating element in accordance with a signal ENB (ENBI) for determining the width of a pulse for driving the heat energy generating element 2009, thereby driving the heat energy generating element 2009. Note that each of the signals EA*, EB*, and EC* is a 1-bit signal. These signals determine which one of outputs (terminals 1 to 8) from the decoder 303 are to be set at high level. The signal EG* is a signal for enabling an output from the decoder 303.

In this embodiment, 7,168 nozzles are arranged in one printhead unit 2100 at a density of 600 dpi (42.5-μm intervals), which are driven at a driving frequency of 4 kHz. The heat energy generating element 2009 is an electric resistor having a size of about 20 μm×80 μm and a resistance of about 55 Ω. When a voltage pulse of about 10 to 12 V (pulse width: about 3 μs) is supplied to this heat energy generating element 2009, ink near the heat energy generating element 2009 is heated to form a bubble, thereby discharging ink from the nozzle. At this time, a current of about 200 mA instantaneously flows in the single heat energy generating element 2009. The ink bubble formed by the heat energy generating element 2009 upon application of a pulse signal has a maximum volume about 12 μs after the application of the pulse signal to the heat energy generating element 2009. Thereafter, the ink bubble starts shrinking, and disappears about 25 μs after the application of the pulse.

Figure 4:
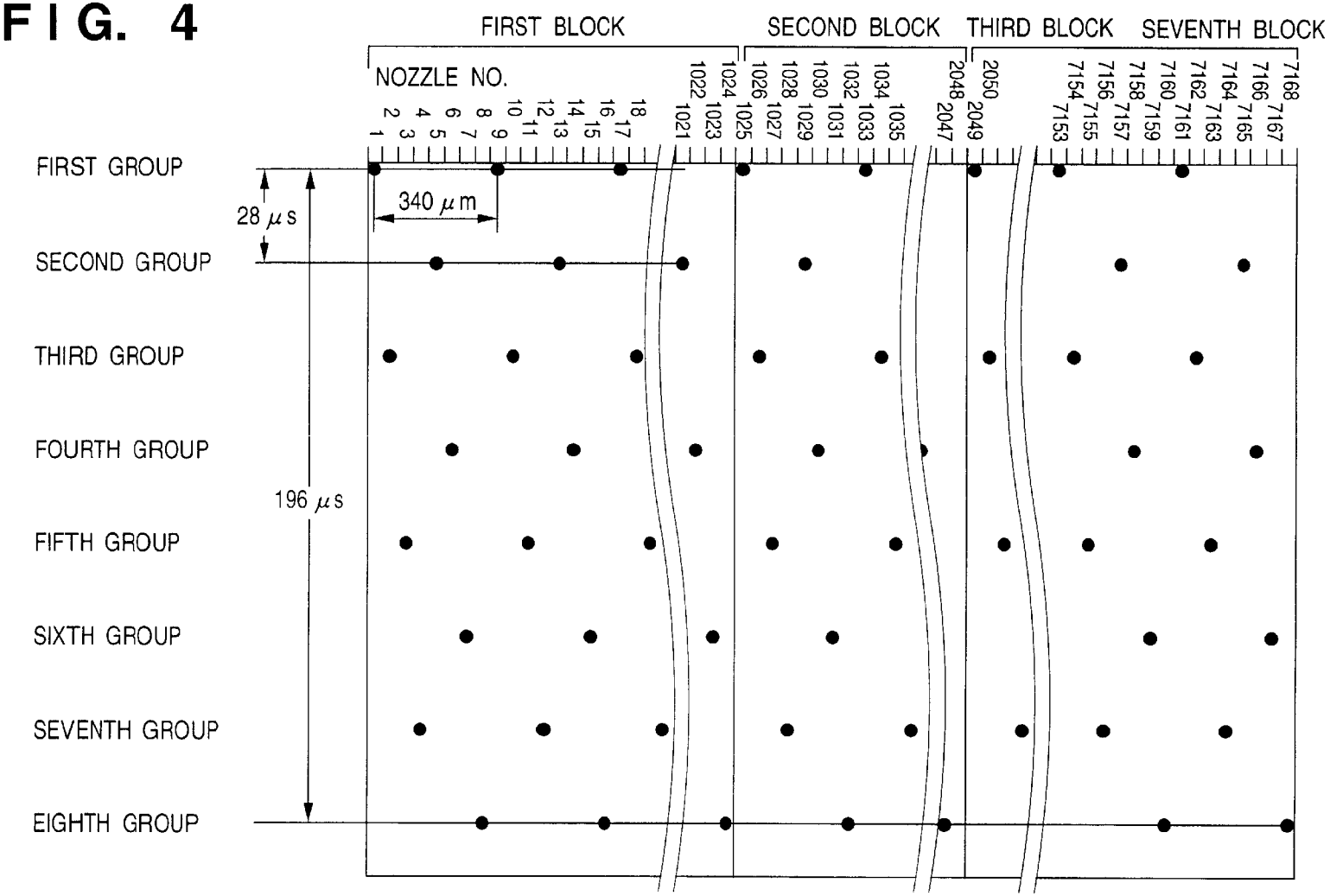
FIG. 4 is a schematic view for explaining a driving sequence in a printhead unit according to the embodiment of the present invention.

FIG. 4 is a view for explaining the ink discharge timing of the printhead unit 2100 of this embodiment.

In the first embodiment, all the nozzles (7,168) arranged on the printhead unit 2100 are formed into eight (=N) groups, and time-divisional driving is performed in units of groups by using the above signals EA*, EB*, and EC*. In printing, first of all, ink is discharged from the 1st, 9th, 17th, . . . , 7,162nd (a total of 896) nozzles belonging to the first group. At this time, an instantaneous current of about 200 mA flows in the single heat energy generating element 2009. In this case, since a maximum of 896 heat energy generating elements 2009 are simultaneously turned on, the total instantaneous current is about 180 A at maximum. Ink is then discharged from the 5th, 13th, . . . , 7,165th nozzles belonging to the second group. Subsequently, ink is sequentially discharged from the nozzles belonging to the third, fourth, . . . , eighth groups in the same manner. In this case, the nozzles of the groups driven at successive timings are spaced apart from each other by N/2 dots (4 dots in this case) or {N/2)−1} dots (3 dots in this case). For example, the 5th nozzle belonging to the second group is spaced apart from each of the 1st and 9th nozzles belonging to the first group by (N/2=) 4 dots, and is spaced apart from each of the 2nd and 10th nozzles belonging to the third group, which is driven afterward, by {(N/2)−1 =} 3 dots. Setting the distance between the nozzles belonging to the groups driven at successive timings to N/2 bits or {(N/2)−1} will reduce the influences of the pressure waves of ink droplets discharged from given nozzles at a timing immediately before the current timing on ink droplets discharged from nozzles at the current timing.

In this embodiment, the time interval (to be referred to as a group delay time td) between successive ink discharge timings at which nozzle groups are driven is set to about 28 μs. To form an image with one pass, a driving period T of a head and a group count N must satisfy $$td \leqq T/N$$

To reduce the influences of pressure waves generated by nozzles which have discharged ink at a timing immediately before the current timing and stabilize an ink discharge speed and ink discharge amount, the group delay time td must be longer than at least a time tmax (about 12 μs) between the instant at which an electric pulse is applied to the heat energy generating element 2009 and the instant at which a formed bubble reaches its maximum volume:

$$tmax < td$$

In addition, the group delay time td is preferably longer than a time tb (about 25 μs) taken for the formed bubble to shrink. Therefore, we have $$tb < td$$

Figure 5:
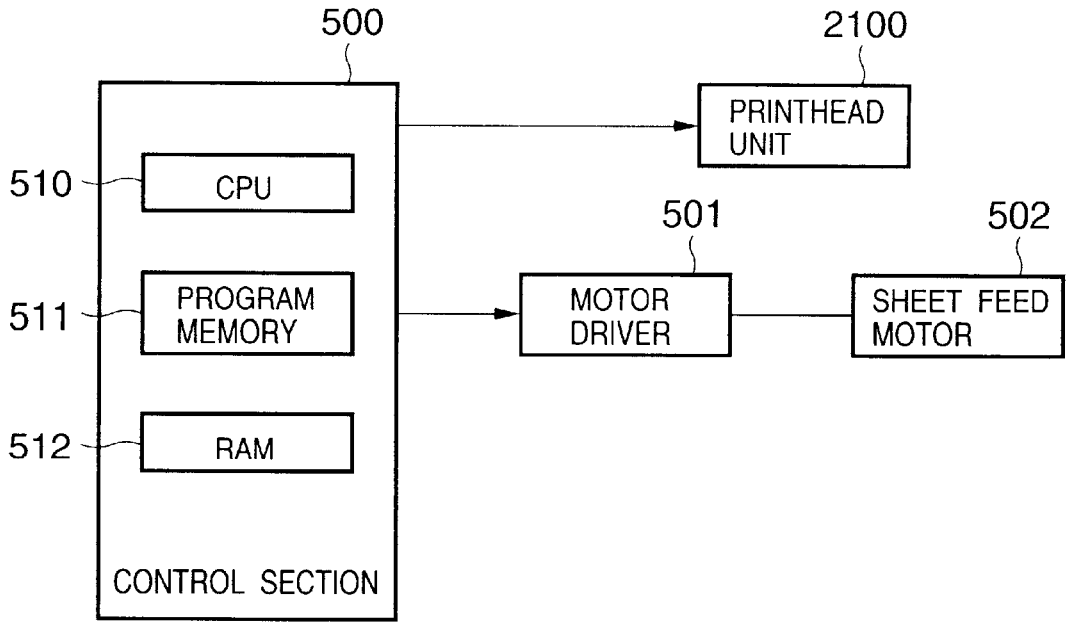
FIG. 5 is a block diagram showing the arrangement of an ink-jet printer according to the embodiment of the present invention.

FIG. 5 is a block diagram showing the arrangement of an ink-jet printer having the full-line type printhead according to the first embodiment of the present invention.

Referring to FIG. 5, reference numeral 500 denotes a control unit including a CPU 510 such as a microprocessor, a program memory 511 storing control programs executed by the CPU 510, a RAM 512 which is used as a work area when the CPU 510 executes processing and temporarily stores various data, and the like. Reference numeral 2100 denotes the printhead unit described above; and 501, a motor driver for controlling the rotation of a sheet feed motor 502 on the basis of an instruction from the control unit 500, thereby conveying a printing sheet used for printing.

Figure 6:
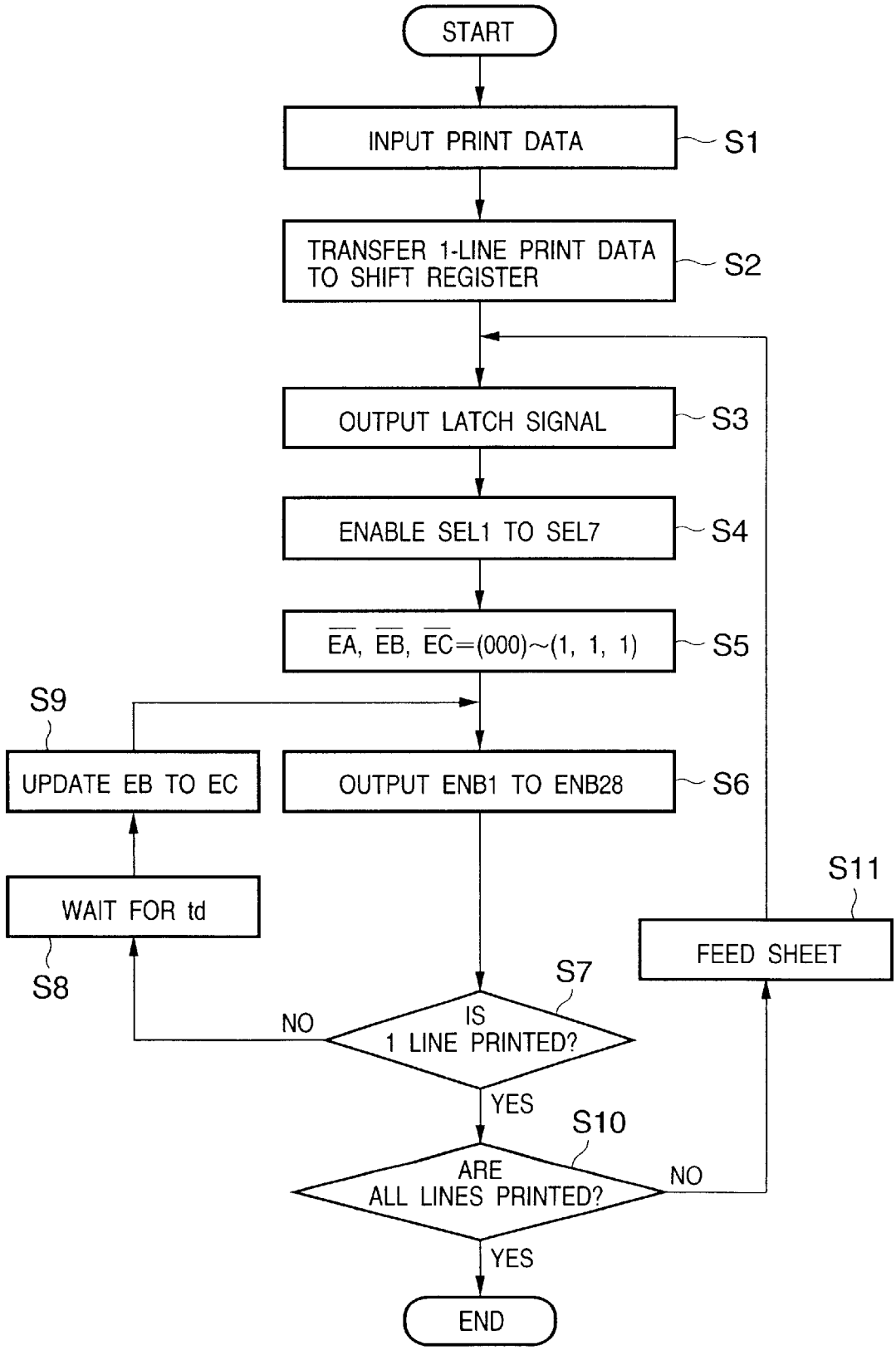
FIG. 6 is a flow chart showing control processing in the control unit of the ink-jet printer according to the embodiment of the present invention.

FIG. 6 is a flow chart showing control processing in the ink-jet printer according to the first embodiment. A control program for executing this processing is stored in the program memory 511.

In step S1, print data is input from an external device such as a host computer. After 1-line (7,168 pixels) data is created, the flow advances to step S2 to send out the created image data to the shift register 301 of each driving element of the printhead unit 2100 in synchronism with the clock signal CK. When the 1-line print data is stored in each of the shift registers 301 of IC1 to IC28, the flow advances to step S3 to output a latch signal (LT*) to latch the print data in the latch register 302 of each driving element. The flow then advances to step S3 to convey a printing sheet by rotating the sheet feed motor 502 and by using an electrostatic chuck method (to be described later). When the printing sheet reaches a print position, the flow advances to step S4. In step S4, all the selection signals SEL1 to SEL7 for selecting the first to seventh blocks are set at high level. In step S5, all the group selection signals EA*, EB*, and EC* are set at "1" (selecting the first group). The flow then advances to step S6 to set heat signals (ENB1 to ENB28) at high level. With this operation, the heating resistors of the first group in FIG. 4 are driven to print by using ink discharged from the nozzles of the first group.

The flow then advances to step S7 to check whether 1-line printing is complete. If NO in step S7, the flow advances to step S8 to wait for a predetermined period of time (group delay time td). The flow then advances to step S9 to update the group selection signals EA*, EB*, and EC* described above and select the second group (EA*=0, EB*=EC*=1). The flow advances to step S6 to set heat signals (ENB1 to ENB28) at high level and print by using the next nozzle group in the same manner as described above. When groups are sequentially selected in steps S7 to S9 and printing by the eighth group (EA*, EB*, EC*=0) is complete, the flow advances to step S10 to check whether 1-page printing operation is complete. If YES in step S10, this processing is terminated. If NO in step S10, the flow advances to step S11 to convey the printing sheet by, for example, one dot corresponding to the resolution by rotating the sheet feed motor 502. The flow then returns to step S3. In this case, reception of data from the host or the like, creation of printing data, transfer of the printing data to the shift register 301, and the like are executed in the background during printing of a previous line. By outputting a latch signal in step S3, printing data of the next line is latched by the latch register 302.

As described above, the nozzles of the printhead are formed into N groups and time-divisionally driven to reduce the influences of pressure waves generated by nozzles which have discharged ink at a preceding timing on ink discharge amount and ink discharge speed, thereby stably discharging ink. This makes it possible to improve the print quality.

A characteristic feature of this embodiment is that when time-divisional driving described above is performed, the intervals between nozzles that simultaneously discharge ink are so set as to prevent static electricity produced in conveying a printing sheet by the electrostatic chuck method from affecting a printed image. This embodiment will be described below.

[Second Embodiment]

In this embodiment, a printhead unit has nozzles arranged at a pitch of 42.5 μm, i.e., at a higher density than in the first embodiment. In this embodiment, as in the first embodiment, when a condition under which the ink droplet landing position offset amount became ½, i.e., 21.25 μm or less, the nozzle pitch of 42.5 μm or less was obtained, the obtained condition was that the distance between adjacent nozzles that were simultaneously turned on should be set to 300 μm or more. On the basis of this result, the number (N) of groups for divisional driving was set to 8 in a printhead having a nozzle resolution of 600 dpi (nozzle pitch p=42.5 μm) according to this embodiment.

In addition, according to this embodiment, in consideration of the time interval between the discharge timings of nozzles belonging to groups which are adjacent to each other in an ink discharge sequence, a group delay time td is set to be sufficiently longer to prevent the ink droplets discharged from the nozzles belonging to the groups adjacent to each other in the ink discharge sequence from mutually interfering with their flying directions due to an electrostatic field until they land on a printing sheet 1005.

This operation will be described with reference to FIG. 11.

Figure 11:
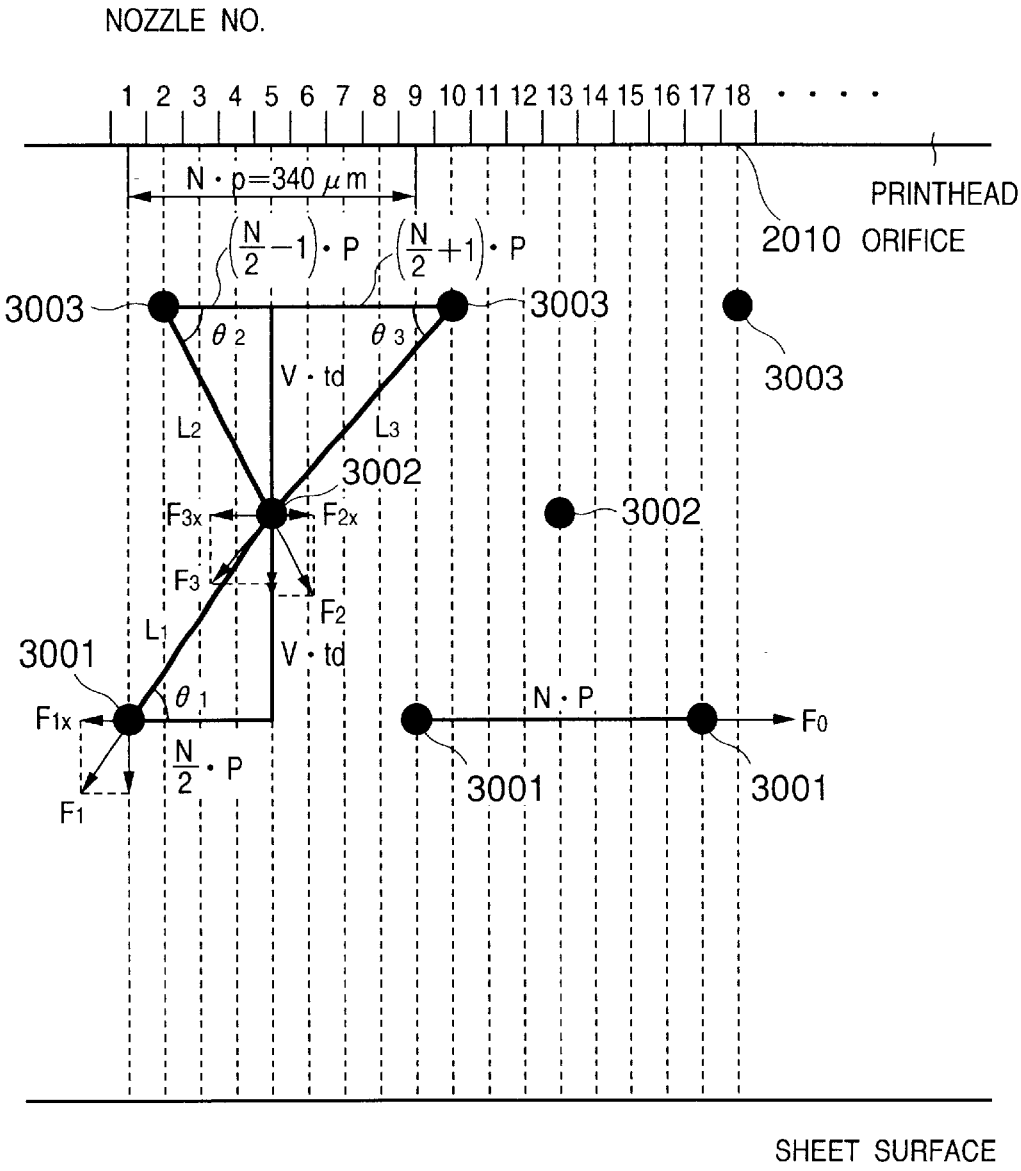
FIG. 11 is a graph for explaining how ink is sprayed by an ink-jet printer according to the embodiment of the present invention.
Figure 12:
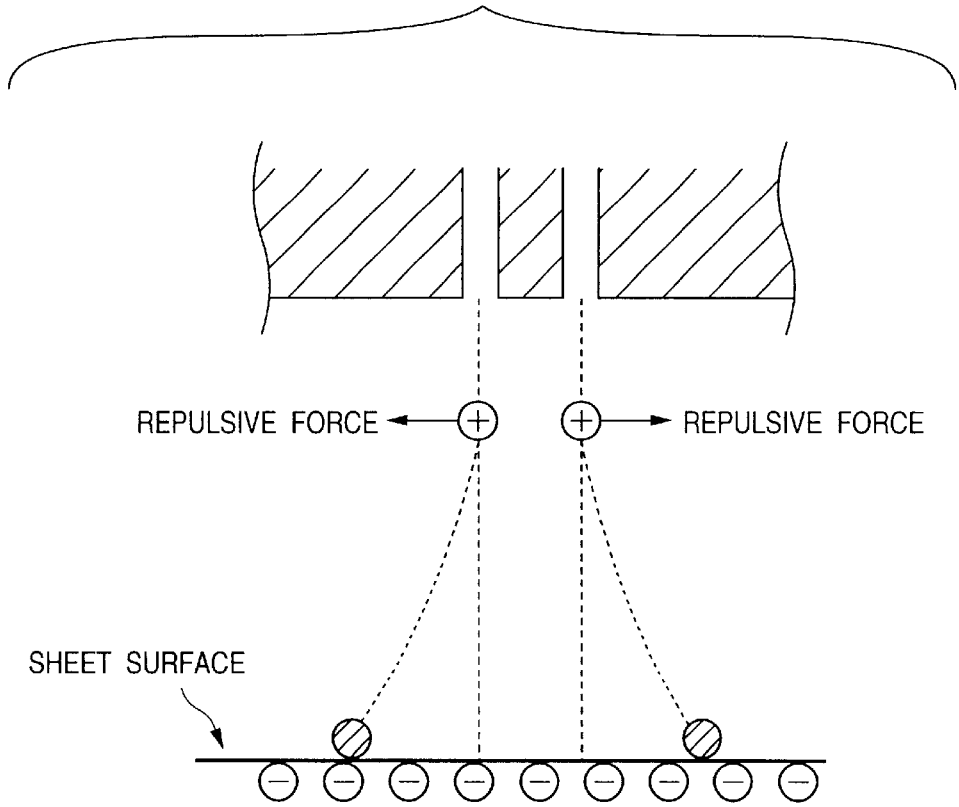
FIG. 12 is a schematic view for explaining how ink droplets are sprayed from a conventional printhead.

FIG. 11 shows a state wherein ink droplets 3001, 3002, and 3003 discharged from the printhead are flying before they land on the printing sheet 1005 in the second embodiment. A horizontal distance L between the ink droplet 3001 from a nozzle belonging to the first group and the ink droplet 3002 from a nozzle belonging to the second group can be expressed by $$L=P\cdot N/2$$

where N is the number of groups for divisional driving, and P is the nozzle pitch.

A vertical distance VH between them can be expressed by $$V1=V\cdot td$$

where V is the flying speed of ink, and td is the group delay time.

A linear distance L1 between the ink droplet 3001 from the nozzle belonging to the first group and the ink droplet 3003 from the nozzle belonging to the second group is given by $$L1=\sqrt{\{V^2\cdot td^2+(N\cdot P/2)^2\}}$$

In an electrostatic field, a force F1 that ink droplet 3001 receives from the ink droplet 3002 is proportional to the square of this linear distance L1, and hence can be given by $$F1=\alpha\cdot L1^2=\alpha\sqrt{\{V^2\cdot td^2+(N\cdot P/2)^2\}}$$

where α is a constant. Of the force F1, only a horizontal component F1*x* influences the landing position of the ink droplet 3001. In this case, the component F1*x* is given by $$F1x=F1\cdot\cos\theta 1=\alpha\cdot(L1^2)\cdot(NP/2)L1$$

$$=\alpha\cdot(NP/2)\sqrt{\{V^2\cdot td^2+(N\cdot P/2)^2\}}$$

Likewise, consider the force that the ink droplet 3002 from the nozzle belonging to the second group receives from the ink droplet 3003 from the nozzle belonging to the third group. The horizontal distance between the ink droplet 3002 and the ink droplet 3003 is given by either (N/2−1)·P or (N/2+1)·P. With regard to the respective expressions, horizontal components F2*x* and F3*x* that are received in an electrostatic field are given by $$F2x=[\alpha P\cdot\{(N/2)-1\}]\sqrt{\{V^2\cdot td^2+\{(N/2)-1\}^2\times P^2\}}$$

$$F3x=[\alpha P\cdot\{(N/2)+1\}]\sqrt{\{V^2\cdot td^2+\{(N/2)+1\}^2\times P^2\}}$$

F3*x* is the largest among F1*x*, F2*x*, and F3*x*.

The horizontal distance between ink droplets from nozzles belonging to the same group can be expressed by N·P, and a force F0 that each ink droplet receives from another ink droplet while they fly is given by $$F0=\alpha\cdot N^2\cdot P^2$$

According to the above equalities, a condition for setting the above component F3*x* to F0 or less is given by $$\sqrt{[V^2\cdot td^2+\{(N/2)+1)^2\times P^2]^2\times P^2}]1\leqq 2N^2\cdot P/(N+2)$$

When a driving method satisfying:

$$N\cdot P>300$$

$$\sqrt{[V^2\cdot td^2+\{(N/2)+1)\}^2\times P^2]}\leqq 2N^2\cdot P/(N+2)\ \text{Ps for}$$

$$V=10\ [\text{m/S}],\ td=28\ [\mu\text{s}],\ N=8,\ P\ 42.5\times 10^{-6}\ [\text{m}]$$

was actually taken, ink landing position offsets due to an electrostatic field fell within 15 μm, and good print quality was obtained.

As described above, according to the third embodiment, an ink-jet printer is provided, which can minimize the landing position offset of each ink droplet due to an electrostatic field to realize excellent printing when the printhead described in the first and second embodiment is mounted in an ink-jet printer using the electrostatic chuck method.

[(Third Embodiment]

Figure 7:
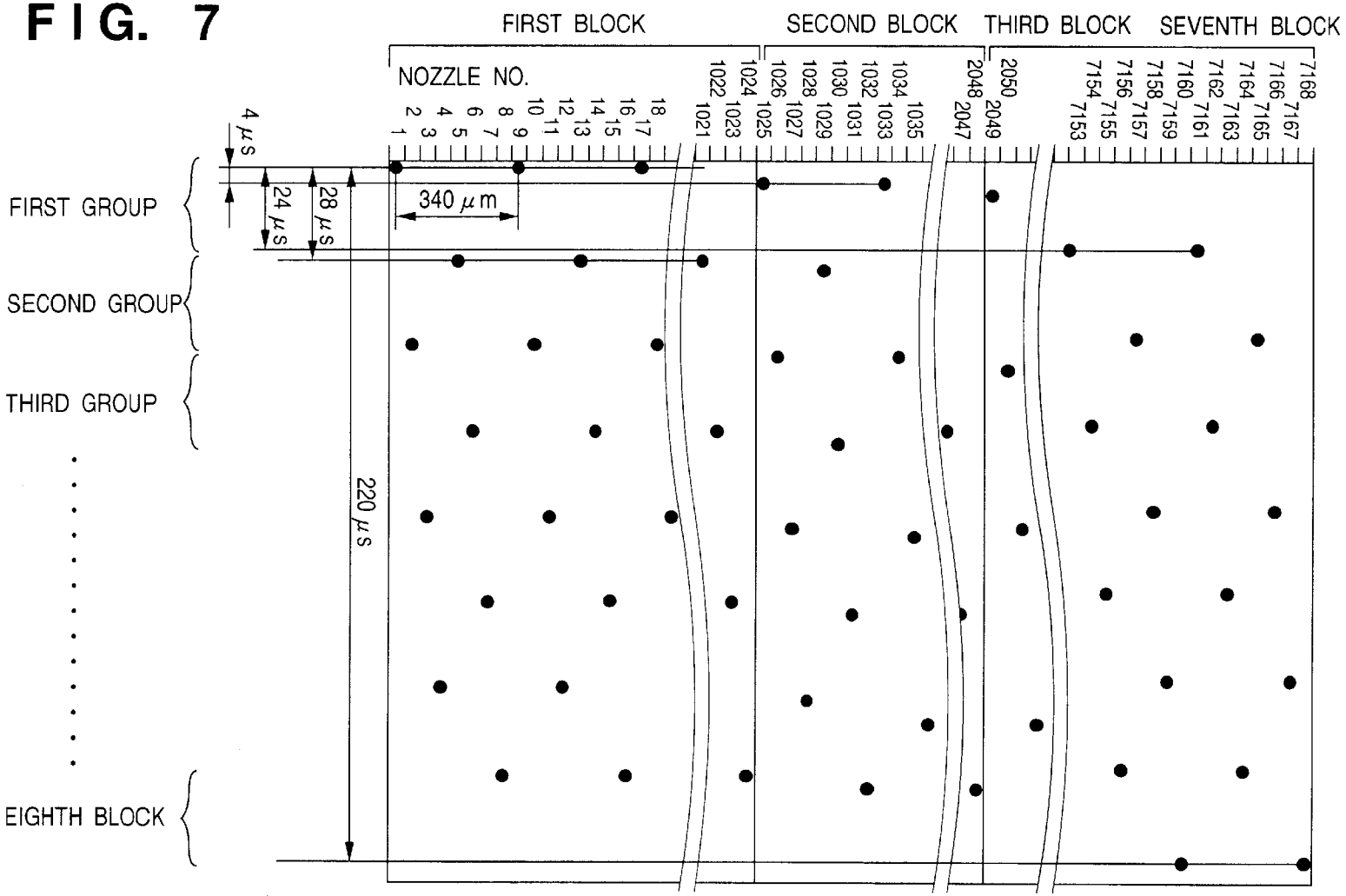
FIG. 7 is a schematic view for explaining a driving sequence in a printhead unit according to the embodiment of the present invention.

FIG. 7 is a view for explaining the third embodiment of the present invention. As in the first embodiment, in the third embodiment, the nozzles of a printhead unit 2100 are formed into eight groups to be time-divisionally driven, and it is determined the intervals between nozzles that are simultaneously driven in consideration with an effect of the electrostatic chuck method. The third embodiment differs from the first embodiment in that the nozzles belonging to each group of the printhead unit 2100 are further grouped into seven blocks, i.e., the first to seventh blocks, and the nozzles belonging to the same group are further time-divisionally driven.

As shown in FIG. 7, ink is discharged from the nozzles belonging to the first block of the first group, and then ink is discharged from the nozzles belonging to the second block of the first group with a delay of about 4 μs. Subsequently, the nozzles belonging to the third to seventh blocks of the first group are sequentially driven with a delay of 4 μs to discharge ink. Note that each group is selected by signals EA*, EB*, and EC* like those described above, and each block is selected by signals SEL1 to SEL7.

When printing by the nozzles belonging to the first group is completed in this manner, ink is discharge from the nozzle belonging to the first block of the second group. By dividing the driving timing of the 896 nozzles belonging to the same group into seven timings, the number of heat energy generating elements 2009 simultaneously driven can be further decreased to 128. As a consequence, since a current of about 200 mA instantaneously flows in the signal heat energy generating element 2009, the sum of currents that instantaneously flows in the elements can be reduced to about 25.6 A at maximum.

Figure 8:
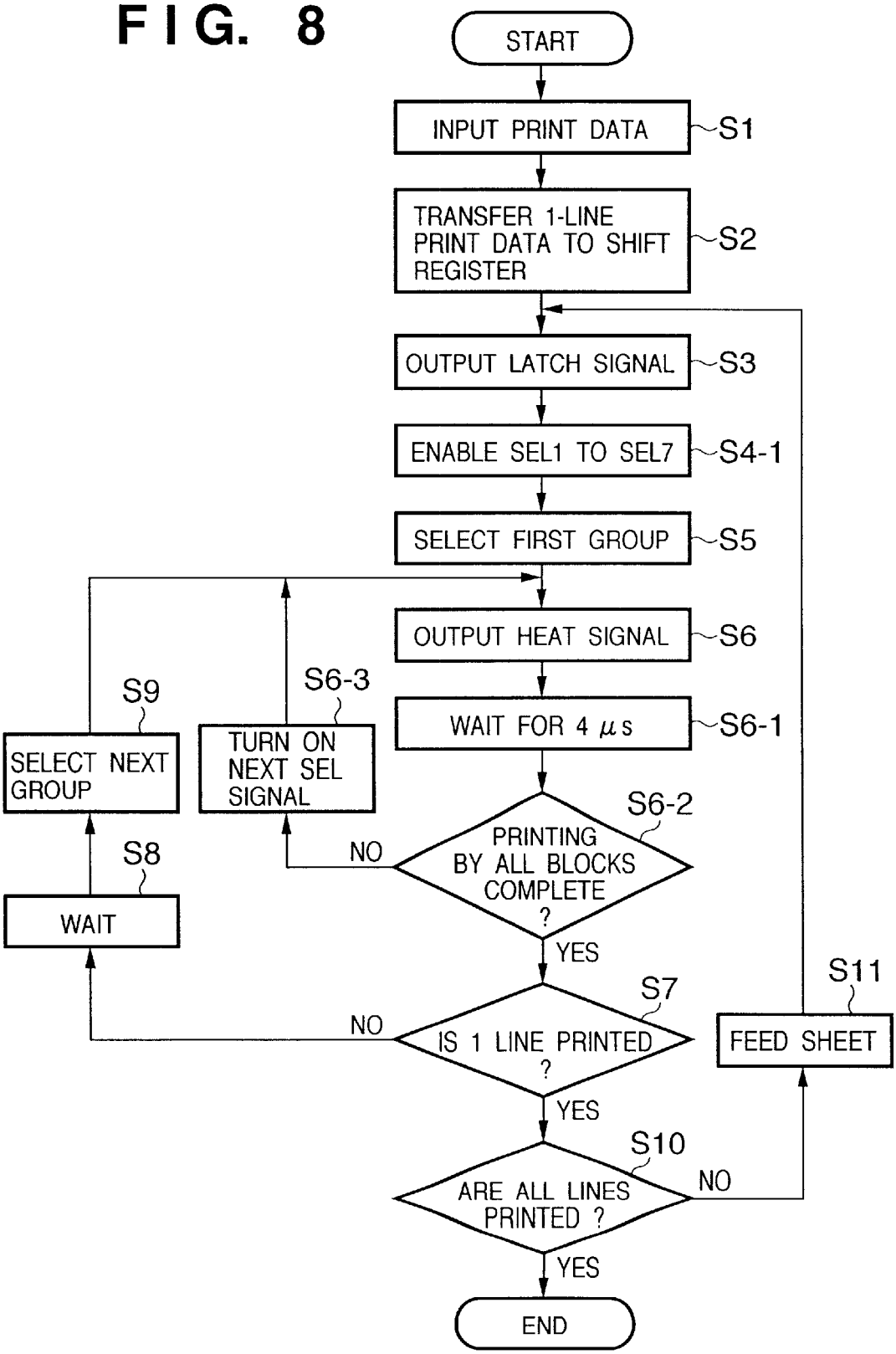
FIG. 8 is a flow chart showing control processing in the control unit of the ink-jet printer according to the embodiment of the present invention.

This processing is shown in the flow chart of FIG. 8. Since the arrangement of the ink-jet printer of the third embodiment is the same as that of the first embodiment, a description thereof will be omitted. The same reference numerals as in the flow chart of FIG. 6 denote the same part in FIG. 8, and a description thereof will be omitted.

In the third embodiment, the first block is selected (SEL=1, SEL2 to SEL7=0) in step S4-1 after step S3. In step S5, the first group is selected by setting the signals EA*, EB*, and EC*=(1, 1, 1). In step S6, ENB1 to ENB28 are output to drive the heating resistors. In step S6-1, the flow waits for 4 μs. The flow then advances to step S6-2 to check whether printing by all the blocks belonging to the first group is complete. If NO in step S6-2, the flow advances to step S6-3 to output a selection signal SELi (I=1 to 7) for selecting the next block. When printing by the nozzles belonging to the first group is complete, the flow advances to step S7 to check whether printing of one line (by the nozzles belonging to the first to eight groups) is complete. If NO in step S7, the flow advances to step S8. If YES in step S7, the flow advances to step S10.

As described above, according to the third embodiment, the nozzles belonging to the same group are further grouped into a plurality of blocks, and time-divisional driving is performed in units of bocks, thereby reducing the maximum current instantaneously flowing in the printhead. This makes it possible to reduce the load imposed on the head power supply, power supply capacitor, and the like and more stably discharge ink.

Figure 9:
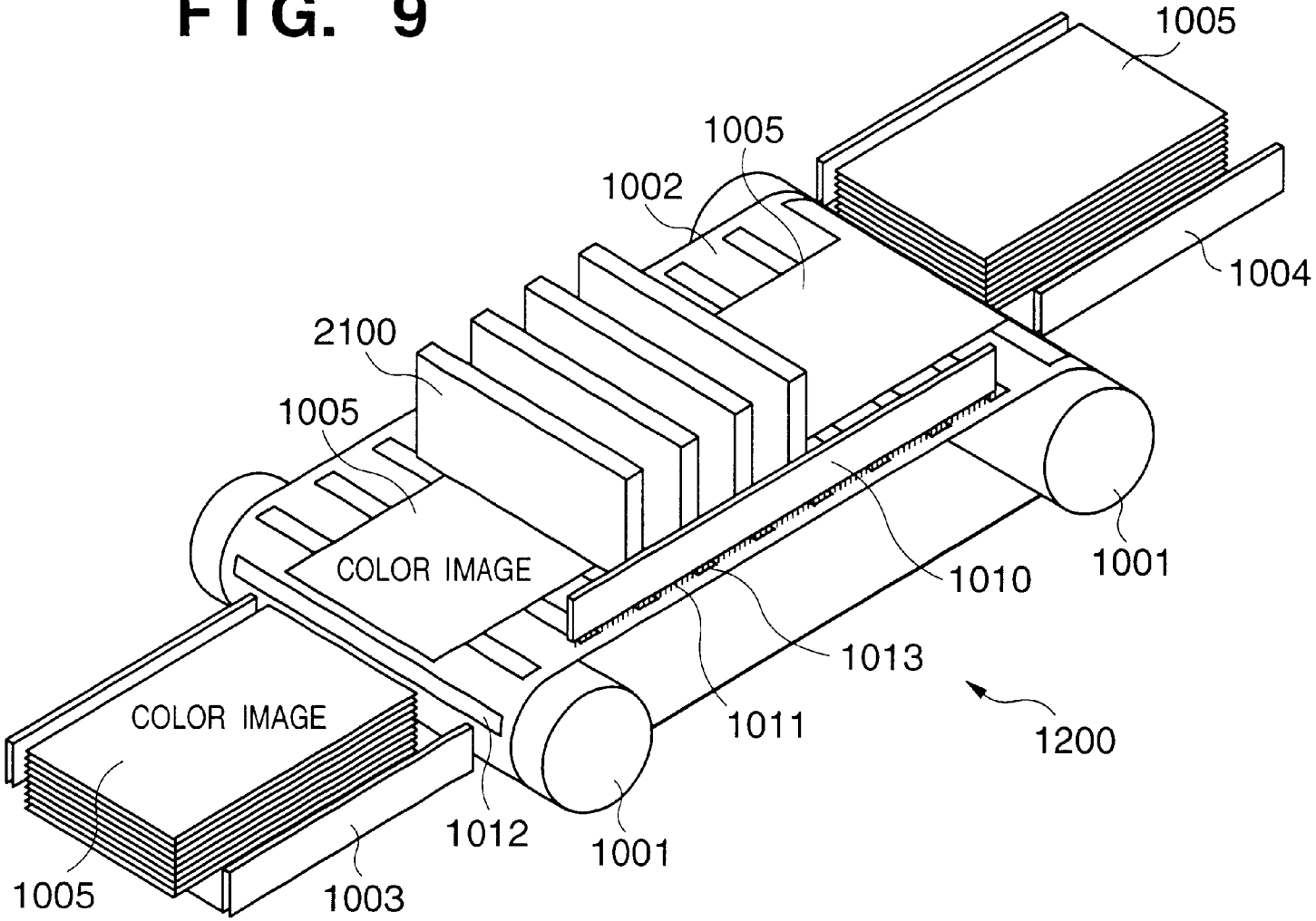
FIG. 9 is a schematic perspective view of an ink-jet printer according to the embodiment of the present invention.

FIG. 9 is a view for explaining a color ink-jet printer 1200 designed to electrostatically convey a printing sheet according to the present invention. The color ink-jet printer 1200 of the this embodiment incorporates four printhead units 2100 identical to those described above. Each printhead unit 2100 in this embodiment has the same arrangement as that described above except that the nozzle pitch is set to 63.5 μm. Yellow, magenta, cyan, and black inks are respectively supplied to the four printhead units 2100. These printer units print color images by using these four colors. A printing sheet 1005 stacked on a paper tray 1004 is conveyed by a sheet convey belt 1002. When the printing sheet 1005 passes under the color printhead units 2100, a color image is printed on this sheet by using inks discharged from the respective printhead units 2100. The printing sheet 1005 on which the color image is printed in this manner is stacked on a paper discharge tray 1003.

The sheet convey belt 1002 is looped around a sheet convey belt roller 1001. Electrodes 1012 are arranged on this sheet convey belt 1002 to reliably convey the printing sheet 1005. Feed portions 1013 are arranged at end portions of the electrodes 1012. Charge supply brushes 1011 made of a conductive material and arranged on a charge supply unit 1010 for applying a high potential to the electrodes 1012 are in contact with the feed portions 1013. By applying a high potential to the charge supply unit 1010, the printing sheet 1005 is electrostatically chucked and conveyed.

In this case, the printhead unit 2100 described above is mounted in the color ink-jet printer 1200 designed to convey a sheet by such an electrostatic chuck method.

As described above, when printing is performed by the ink-jet scheme on the sheet convey system using this electrostatic chuck method, ink droplets flying nearby influence their flying directions owing to an electrostatic field, resulting in a deterioration in print quality.

Figure 10:
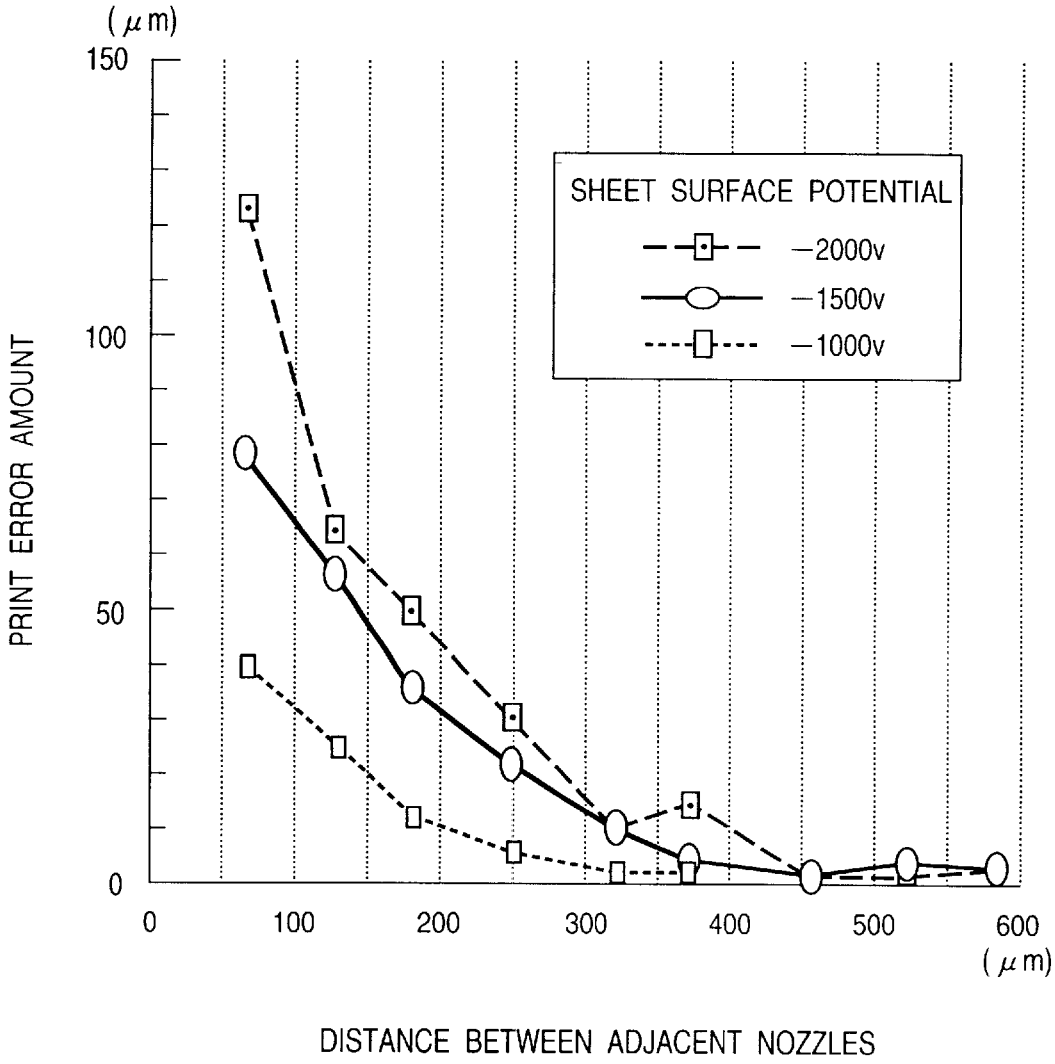
FIG. 10 is a graph for explaining the offset amounts of dot positions in the ink-jet printer.
Figure 17:
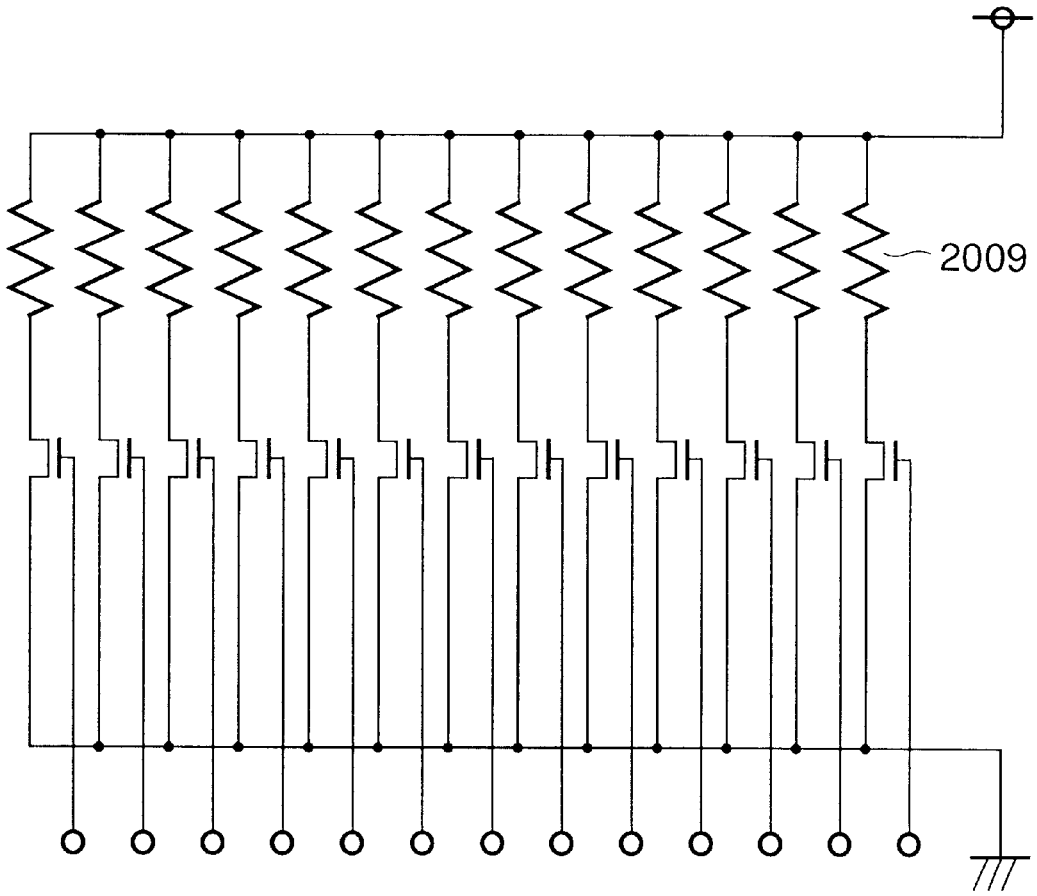
FIG. 17 shows an equivalent circuit of the ink-jet print head for modifying the distances between neighboring nozzles that were driven simultaneously.

Before the printhead unit 2100 of this embodiment was designed, the printhead unit 2100 having a driving circuit capable of independently driving heat energy generating elements 2009 disposed in the respective nozzles was formed first, as shown in FIG. 17, and the relationship between the distances between neighboring nozzles that were driven simultaneously, the voltage applied to the electrodes 1012, and the offset amounts of printed dots was examined on experiment. In this examination, a printhead unit having 512 nozzles arranged at a pitch of 63.5 μm was used. FIG. 10 shows the examination result.

Referring to FIG. 10, the abscissa represents the distance between adjacent nozzles from which ink droplets are simultaneously discharged; and the ordinate, the ink landing position offset amount on a printing sheet.

As shown in FIG. 10, in the 2,000-V range, even with a change in potential applied to the sheet surface, if adjacent nozzles were spaced apart from each other by 300 μm or more, the ink position offset amount was 15 μm or less. In this case, the ink position offset was hardly recognized.

Figure 19:
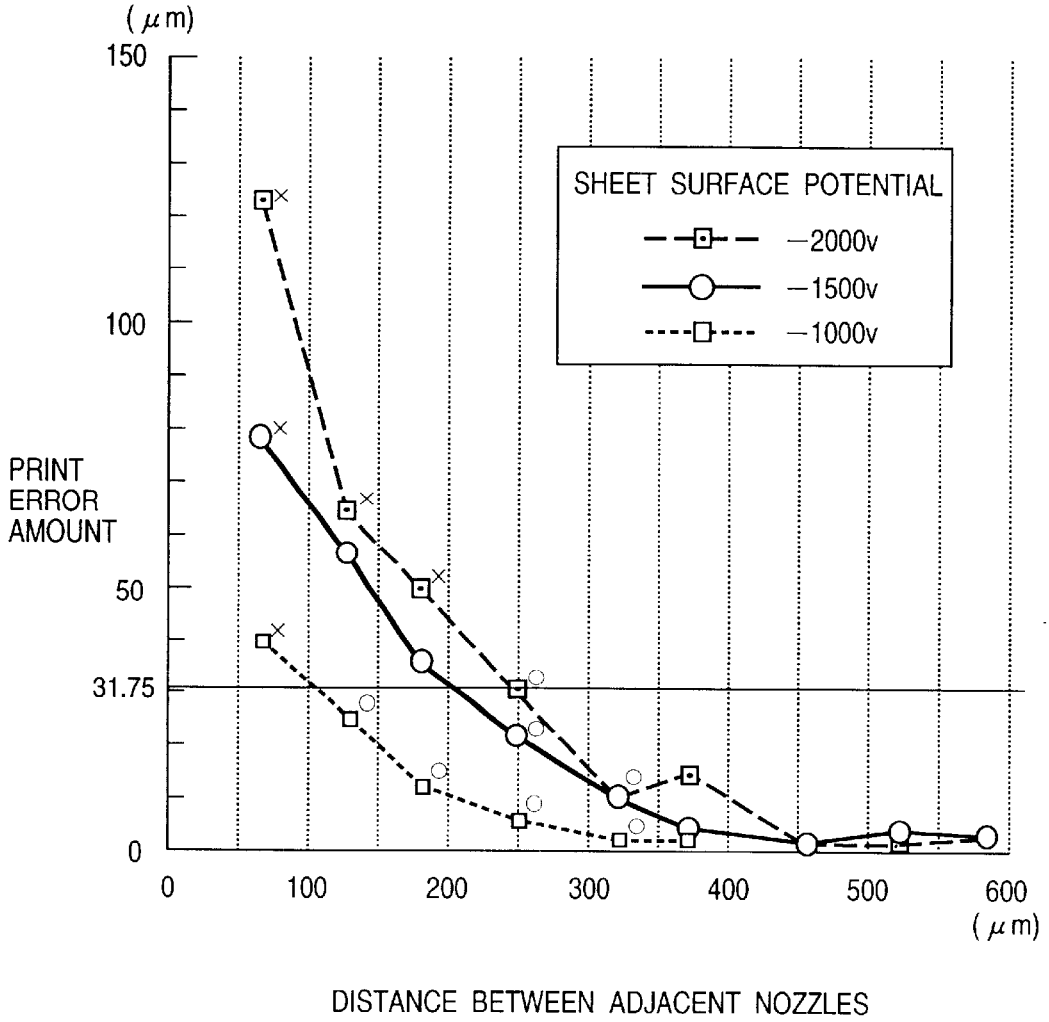
Figure 21:
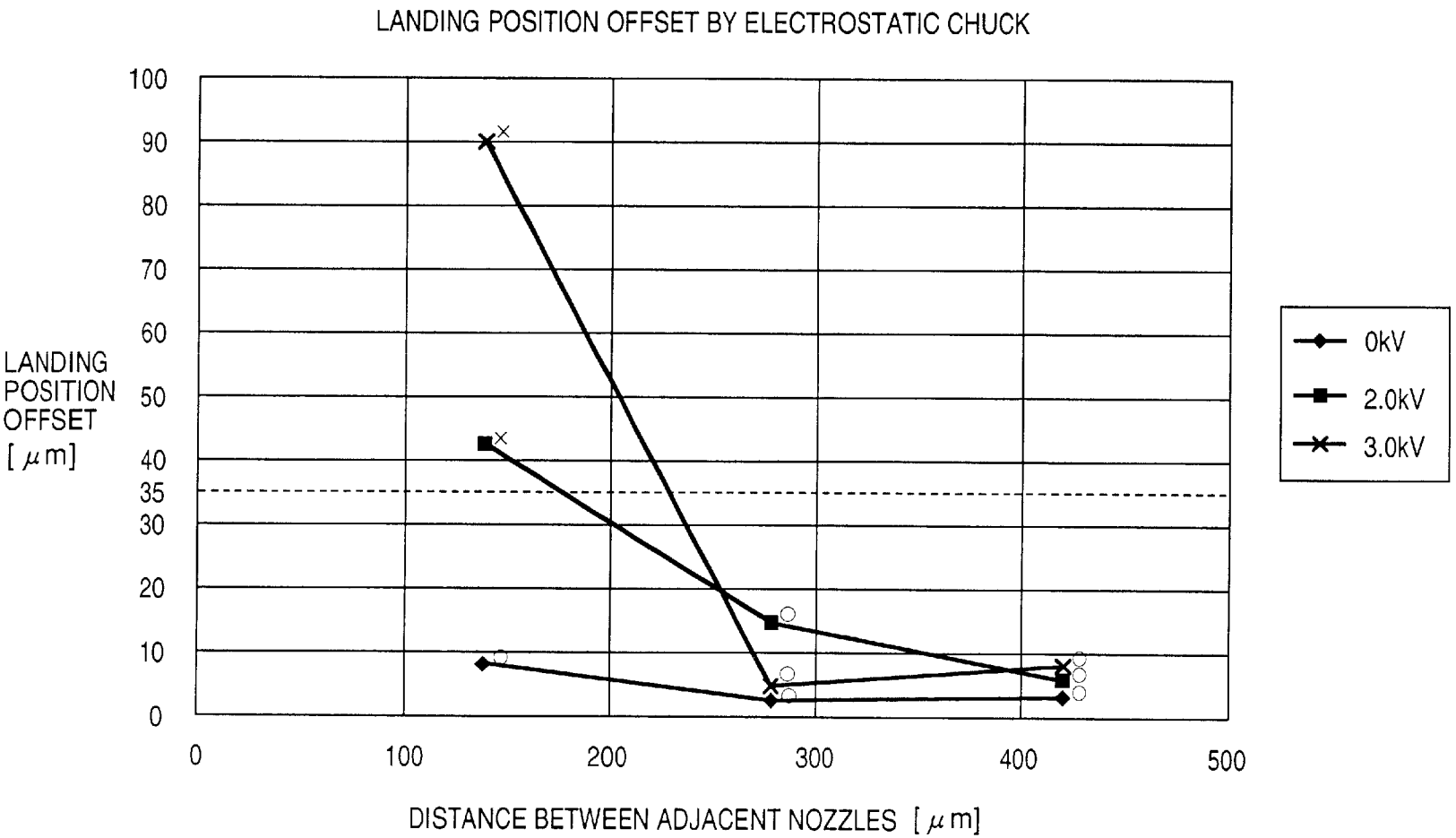

Images were actually printed under the same conditions as in the above experiment, and the resultant print quality was evaluated. FIG. 18 shows the result. A criterion for this image quality evaluation was set such that an image on which the occurrence of streaks due to ink droplet landing position offsets was not recognized was regarded as good "○", and an image on which streaks were produced was regarded as poor "X". FIG. 19 shows the evaluation results, which are superimposed on plotted points under the same conditions as in FIG. 10. Referring to FIG. 19, the print quality evaluation results "○" and "X" are written on the upper right corners of the respective plotted points. Obviously from FIG. 19, image evaluations were "○", i.e., image quality was good in the range in which the print offset amount was ½, i.e., 31.75 μm or less the nozzle pitch of 63.5 μm or less.

In designing a printhead unit having a nozzle pitch of 70 μm on the basis of the above experiment results, the distance between adjacent nozzles that are turned on at the same time when the landing position offset amount became ½70 μm or less, i.e., 35 μm or less was obtained by experiment. The distance between nozzles was set to 140 to 420 μm, and the sheet surface potential was set to 0 to 3 kV. Under these conditions, a landing position offset was measured 10 times, and the measured values were averaged.

As shown in FIG. 20, it was found that when the distance between adjacent nozzles was 140 μm, the landing position offset amount was 35 μm or more at a sheet surface potential of 2 kV or more, whereas when the distance was 280 μm or more, the landing position offset amount could be suppressed to 35 μm or less at a sheet surface potential of 3 kV. In addition, when images were actually printed under the same conditions as described above, and the resultant image quality was evaluated, it was confirmed that good print quality could be obtained when the landing position offset amount was 35 μm or less.

On the basis of the above result, according to this embodiment, an ink-jet printer could be provided, which suppressed a deterioration in image quality due to landing position offsets by using a printhead unit in which the distance between adjacent nozzles that were simultaneously turned on was set to 280 μm.

Furthermore, in the printhead and block driving arrangement shown in FIGS. 1 to 4 described above as well, the distance between adjacent nozzles that were simultaneously driven was set to 340 μm to ensure good images even when the sheet surface potential was set to 2 kV, thereby obtaining good images without any streak irregularity.

[Fourth Embodiment]

Figure 13:
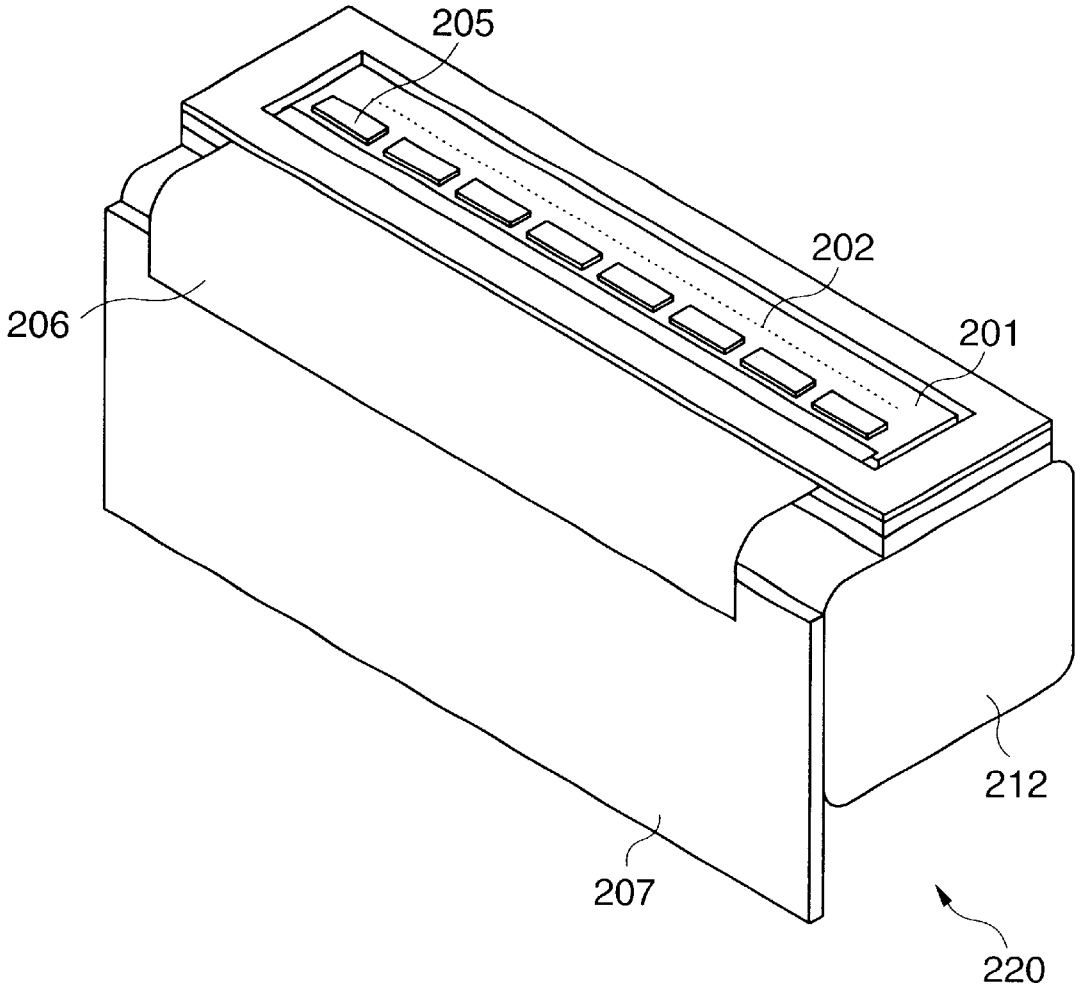
FIG. 13 is a schematic perspective view of an ink-jet printhead according to the embodiment of the present invention.
Figure 14:
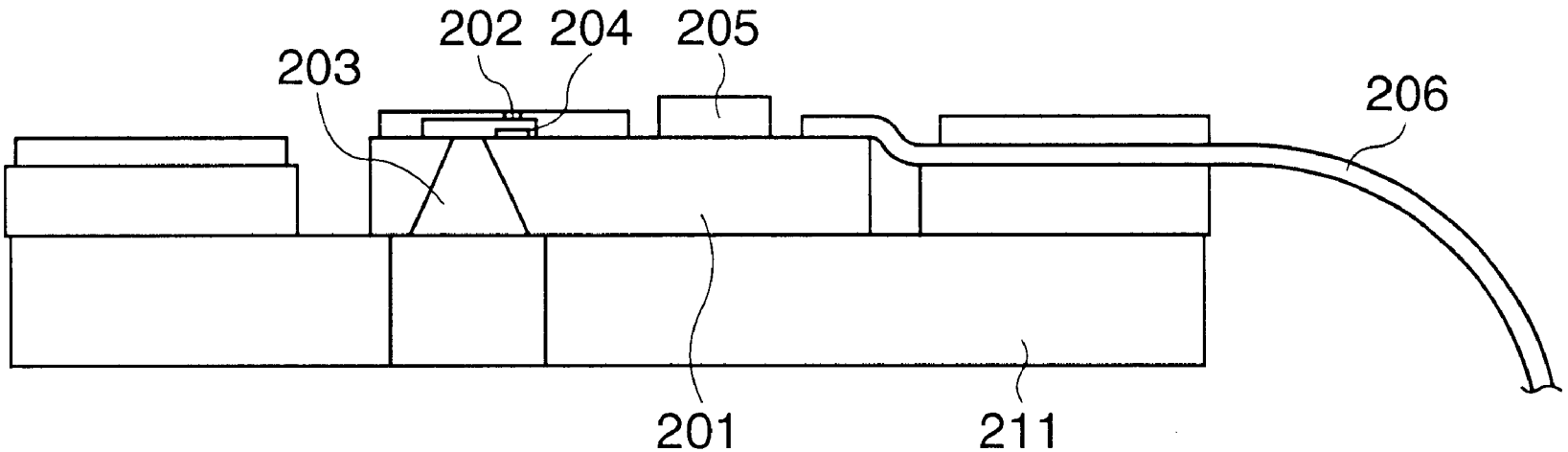
FIG. 14 is a sectional view schematically showing the ink discharging mechanism of the ink-jet printhead according to the embodiment of the present invention.
Figure 15C:
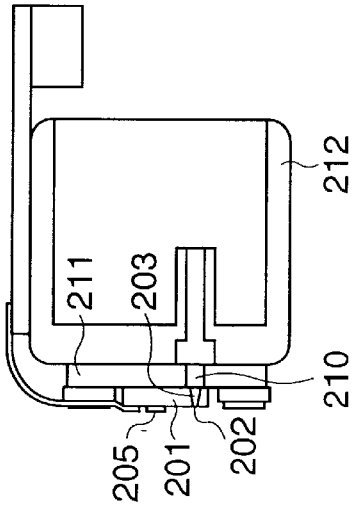
Figure 15A:
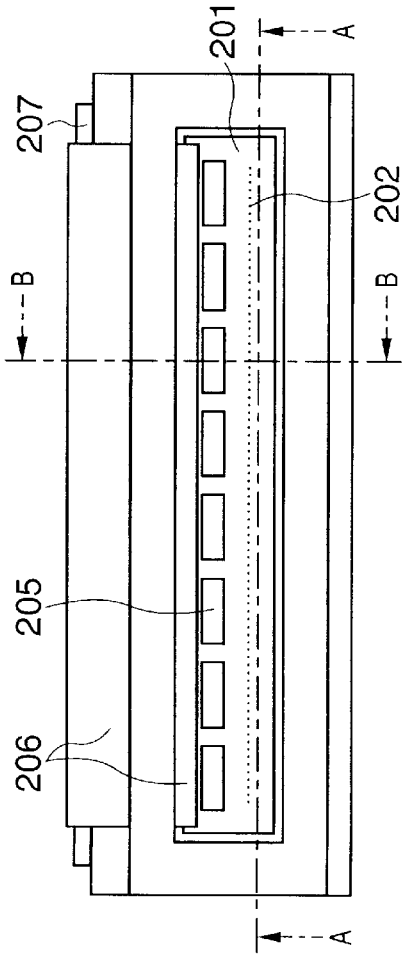
Figure 15B:
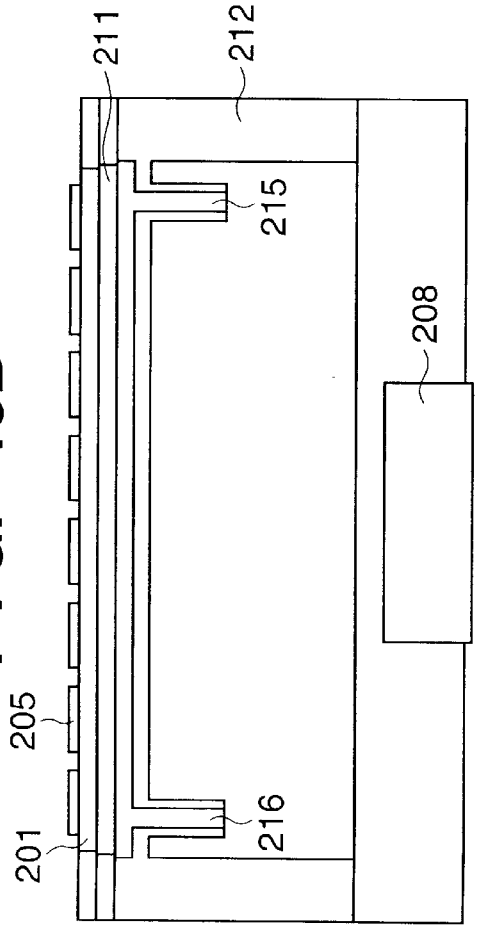

FIGS. 13 to 15C are views for explaining an ink-jet printhead according to the fourth embodiment of the present invention. FIG. 13 is a schematic perspective view of the ink-jet printhead according to the fourth embodiment. FIG. 14 is a sectional view schematically showing the ink discharging mechanism of the ink-jet printhead. FIG. 15A is a schematic plan view of the ink-jet printhead. FIG. 15B is a sectional view taken along a line A—A in FIG. 15A. FIG. 15C is a sectional view taken along a line B—B in FIG. 15A.

In the ink-jet printhead according to the fourth embodiment shown in FIG. 13, a plurality of orifices 202 for discharging ink are formed in that surface portion of a print element board 201 which is located near its middle portion. Printing is performed by using ink droplets discharged from these orifices 202.

As shown in FIGS. 14 and 15A to 15C, heaters 204 corresponding to the respective orifices 202 are formed on the print element board 201. These heaters 204 are energized to generate heat to form ink bubbles. Ink as a printing liquid is discharged by the resultant kinetic energy.

Wires run from the heaters 204 to the mount portions of driving elements 205 on the print element board 201 and are electrically connected to the driving elements 205 mounted on the mount portions. The driving elements 205 are connected to the print element board 201 via an anisotropic conductive film by a COB (Chip On Board) method. In addition to transistor circuits, logic circuits for driving transistors are mounted on the driving elements 205. A signal for driving the logic circuit is connected to a flexible film 206 via the print element board 201. This flexible film 206 is connected to a circuit board 207 (FIG. 15A) made of a composite material such as glass epoxy. An electric connector 208 (FIG. 15B) for receiving external electrical signals is mounted on the circuit board 207.

If the electric connection portions of the driving elements 205 and flexible film 206 are exposed, ink droplets scattered from the orifices 202, ink bouncing off a sheet, and the like adhere to the electrodes. As a consequence, the electrodes and underlying metal corrode. To prevent this, the electric connection portions are coated with a silicon sealant (not shown) having excellent sealing properties and ion-blocking properties and are sealed.

A common liquid chamber 210 (not shown) for holding ink is formed on the lower surface of the print element board 201 by using a print element board holding member 211 and support member 212 so as to have a length almost equal to the length of an array of a plurality of orifices 202. A slit 203 (FIG. 15C) for supplying ink from the lower surface side to the upper surface side is formed in the print element board 201. This common liquid chamber 210 communicates with ink supply ports 215 and 216. In ink discharging operation, ink is supplied from an ink tank (not shown) outside the ink-jet printhead via these two ink supply ports 215 and 216.

In filling this ink-jet printhead with ink, the ink is flowed from the ink supply port (inlet) 215 with pressure, and the air in the common liquid chamber 210 is purged mainly through the ink supply port (outlet) 216, thereby filling the common liquid chamber 210 with the ink without any bubbles. This operation is continued until the common liquid chamber 210 is completely filled with the ink. Meanwhile, ink containing air bubbles is discharged from the ink supply port (outlet) 216. This ink is returned into an ink tank (not shown) located upstream the ink supply port (inlet) 215, thus realizing an ink supply flow path arrangement designed to circulate ink.

Figure 16:
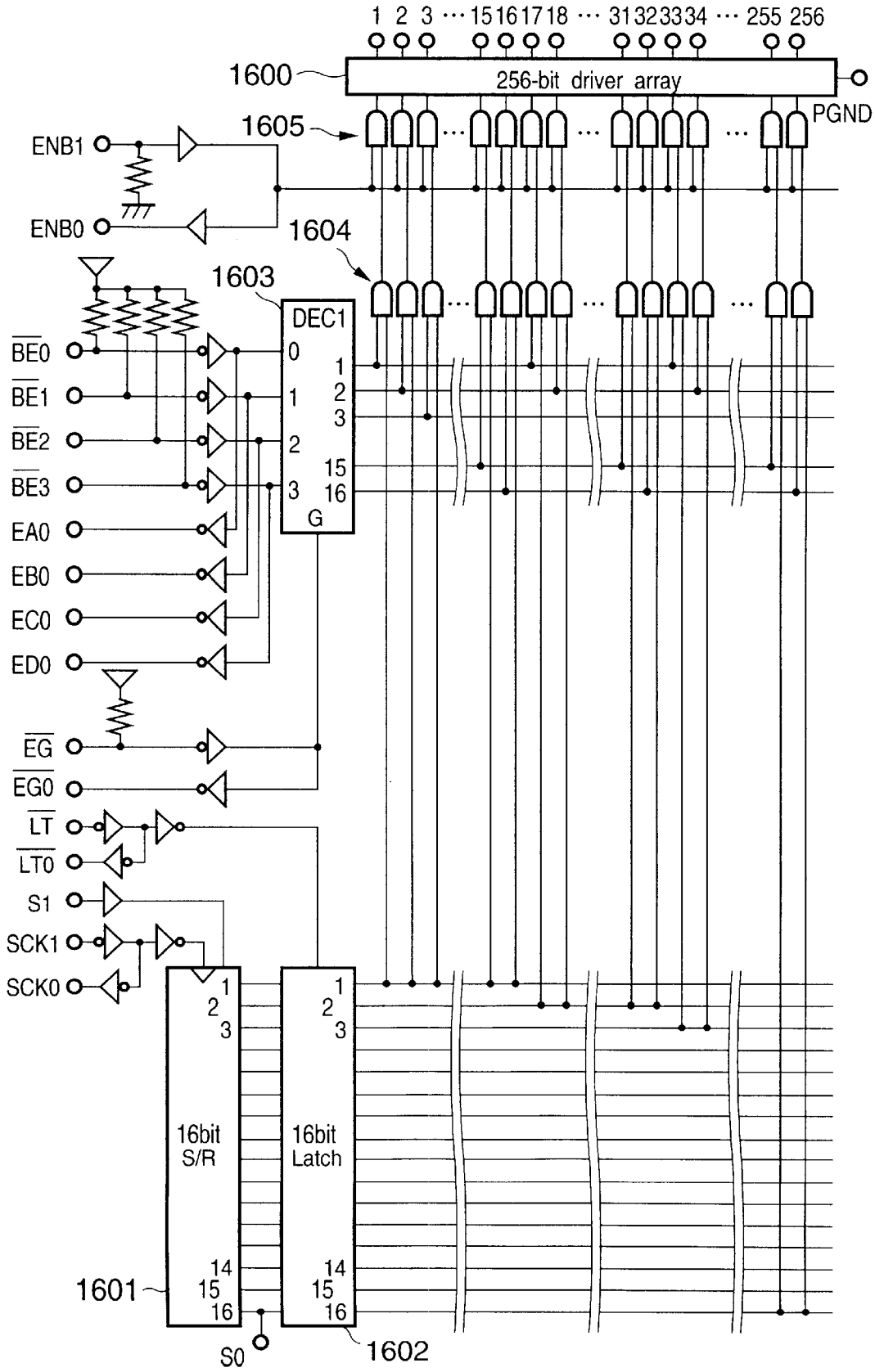
FIG. 16 is a circuit diagram showing the circuit arrangement of an ink-jet head board according to the embodiment.

FIG. 16 is a view showing the circuit arrangement of an ink-jet printhead board according to the fourth embodiment. FIG. 16 shows an example of a driving circuit using a driving IC in which each driving transistor does not have a one-to-one correspondence with a shift register and latch.

As shown in FIG. 16, 256 drivers are used in a driving transistor 1600 per IC, whereas a shift register 1601 and latch 1602 each have a 16-bit configuration. Image data (SI) are serially transferred to the shift register 1601, and 16-bit data is transferred to the shift register 1601 and held therein. Thereafter, this 16-bit data is stored in the latch 1602. Each output from the 16-bit latch is connected to a corresponding one of 16 signal lines, and ANDed with an output signal from a decoder 1603, which is externally controlled/input, by an AND circuit 1604. An AND circuit 1605 further ANDs an output signal from the AND circuit 1604 and an ENB signal (ENB0, ENB1) for determining the width of a pulse for driving the transistor. The driver circuit 1600 is driven by an output signal from the AND circuit 1605.

When image data is to be actually printed, first of all, the image data are sequentially input to the 16-bit shift register 1601. When 16-bit image data are transferred, this image data is latched in the latch circuit 1602. Signals BE0* to BE3* (* represents a negative-logic signal) are input to the decoder 1603 to set only the first output of the decoder 1603 at high level, while the remaining outputs are set low level (BE0* to BE3*=1). When the signal ENB is applied in this state, the 1st transistor element, 17th transistor element, 33rd transistor element, . . . are driven, and ink is discharged from the corresponding nozzles.

As in the above case, the signals BE0* to BE3* are set to (1110) to set only the ninth output of the decoder 1603 at high level, with the remaining outputs being set at low level. When the signal ENB is applied as in the above case, the 9th transistor element, 25th transistor element, 41st transistor element, . . . are driven, and ink is discharged from the corresponding nozzles. By sequentially switching the signals BE0* to BE3* input to the decoder 1603, the corresponding nozzles are driven, for example, in the following sequence, thus discharging ink:

1st, 17th, 33rd, …
9th, 25th, 41st, …
2nd, 18th, 34th, …
10th, 26th, 42nd, …
⋮
16th, 32nd, 48th

By sequentially driving the nozzles in this manner, this embodiment can be applied to the present invention in the same manner as in the embodiments described above.

The present invention has exemplified a printer based a system, which comprises means (e.g., an electrothermal transducer or laser) for generating heat energy as energy utilized upon ink discharge, and causes a change in state of an ink by the heat energy, among the ink-jet printers. However, the same effects as those described above can also be obtained in an ink-jet print system based on a piezoelectric scheme like, for example, the one described in Japanese Patent Laid-Open No. 6-6357. According to this system, a high-density, high-definition print operation can be realized.

As for the typical structure and principle, it is preferable that the basic structure disclosed in, for example, U.S. Pat. No. 4,723,129 or 4,740,796 be employed. The above method can be adopted in both a so-called on-demand type apparatus and a continuous type apparatus. In particular, a satisfactory effect can be obtained when the on-demand type apparatus is employed because of the structure in which one or more drive signals, which rapidly raise the temperature of an electrothermal converter disposed to face a sheet or a fluid passage which holds the fluid (ink) to a level higher than levels at which film boiling takes place are applied to the electrothermal converter in accordance with print information so as to generate heat energy in the electrothermal converter and to cause the heat effecting surface of the printhead to take place film boiling so that bubbles can be formed in the fluid (ink) to correspond to the one or more drive signals. The growth/shrinkage of the bubble will cause the fluid (ink) to be discharged through a discharging opening so that one or more droplets are formed. If a pulse shape drive signal is employed, the bubble can be grown/shrunk immediately and properly, causing a further preferred effect to be obtained because the fluid (ink) can be discharged while revealing excellent responsibility.

It is preferable to use a pulse drive signal disclosed in U.S. Pat. No. 4,463,359 or 4,345,262. If conditions disclosed in U.S. Pat. No. 4,313,124 which is an invention relating to the temperature rise rate at the heat effecting surface are employed, a satisfactory print result can be obtained.

As an alternative to the structure (linear fluid passage or perpendicular fluid passage) of the printhead disclosed in each of the above inventions and having an arrangement that discharge ports, fluid passages and electrothermal converters are combined, a structure having an arrangement that the heat effecting surface is disposed in a bent region and disclosed in U.S. Pat. No. 4,558,333 or 4,459,600 may be employed. In addition, the following structures may be employed: a structure having an arrangement that a common slit is formed to serve as a discharge section of a plurality of electrothermal converters and disclosed in Japanese Patent Laid-Open No. 59-123670; and a structure disclosed in Japanese Patent Laid-Open No. 59-138461 in which an opening for absorbing pressure waves of heat energy is disposed to correspond to the discharge section.

As a full-line type printhead having a length corresponding to the maximum width of a recording medium on which printing can be performed by a printer, a printhead configured to satisfy the requirement for the length by a combination of a plurality of printheads as disclosed in the above specification or a printhead integrated as a single printhead may be used.

In addition, the invention is effective for a printhead of the freely exchangeable chip type which enables electrical connection to the printer main body or supply of ink from the main device by being mounted onto the apparatus main body, or a printhead of the cartridge type having an ink tank provided integrally on the printhead itself.

It is preferred to additionally employ the printhead restoring means and the auxiliary means provided as the component of the present invention because the effect of the present invention can be further stabilized. Specifically, it is preferable to employ a printhead capping means, a cleaning means, a pressurizing or suction means, an electrothermal converter, an another heating element or a pre-heating means constituted by combining them and a pre-ejection mode in which ejection is performed before actual printing ejection in order to stably print.

In addition, the printer of the present invention may be used in the form of a copying machine combined with a reader, and the like, or a facsimile apparatus having a transmission/reception function in addition to a printer integrally or separately mounted as an image output terminal of information processing equipment such as a computer.

The present invention can be applied to a system constituted by a plurality of devices (e.g., host computer, interface, reader, printer) or to an apparatus comprising a signal device (e.g., copying machine, facsimile machine).

The objects of the present invention are also achieved by supplying a storage medium, which records a program code of a software program that can realize the functions of the above-mentioned embodiments to the system or apparatus, and reading out and executing the program code stored in the storage medium by a computer (or a CPU or MPU) of the system or apparatus.

In this case, the program code itself read out from the storage medium realizes the functions of the above-mentioned embodiments, and the storage medium which stores the program code constitutes the present invention.

As the storage medium for supplying the program code, for example, a floppy disk, hard disk, optical disk, magneto-optical disk, CD-ROM, CD-R, magnetic tape, nonvolatile memory card, ROM, and the like may be used.

The functions of the above-mentioned embodiments may be realized not only by executing the readout program code by the computer but also by some or all of actual processing operations executed by an OS (operating system) running on the computer on the basis of an instruction of the program code.

Furthermore, the functions of the above-mentioned embodiments may be realized by some or all of actual processing operations executed by a CPU or the like arranged in a function extension board or a function extension unit, which is inserted in or connected to the computer, after the program code read out from the storage medium is written in a memory of the extension board or unit.

As has been described above, according to this embodiment, a high-quality image can be printed by eliminating the influences of ink droplets discharged from adjacent nozzles.

The present invention is not limited to the above embodiments and various changes and modifications can be made within the spirit and scope of the present invention. Therefore, to apprise the public of the scope of the present invention, the following claims are made.

What is claimed is:

1. An ink-jet printer for printing an image on a printing medium by driving print elements of a printhead and ejecting ink in accordance with an image signal, comprising:

conveyance means for conveying the printing medium by an electrostatic chuck method;

division means for dividing a timing of driving a plurality of print elements of the printhead, in accordance with an image signal, into a plurality of driving timings;

selection means for selecting one of a plurality of print element groups, each group comprising a plurality of print elements of the printhead, wherein the print elements within each print element group are spaced apart from each other with a number of distance units between them, such that the number of distance units equals the number of groups, and wherein the size of the distance unit is defined to eliminate mutual influences of print elements driven at one driving timing, due to an electrostatic field generated by said conveyance means;

driving means for energizing and driving the print element group selected by said selection means in accordance with the image signal at one of the plurality of driving timings;

driving control means for causing, after driving is performed by said driving means, said selection means to select a next print element group shifted by a predetermined amount from said one group, and causing said driving means to drive the next print element group; and control means for causing said driving control means to repeatedly cause said driving means to drive until each of the plurality of print element groups has been selected by said selection means and driven at the plurality of driving timings.

2. The printer according to claim 1, wherein the predetermined intervals correspond to the number (N) of the plurality of driving timings.

3. The printer according to claim 2, wherein relative positions of the print element group driven at a given driving timing of the plurality of driving timings, and the print element group driven at the driving timing before/after the given driving timing, are shifted from each other by at least N/2 or (N/2-1).

4. The printer according to claim 1, further comprising block selection means for segmenting the plurality of print elements of the printhead into a plurality of blocks and selecting the print element groups from within each said block in units of blocks, wherein said driving means energizes and drives the print element group selected by said selection means within each block selected by said block selection means, at one of the plurality of driving timings which are grouped into units equal in number to the plurality of blocks.

5. An ink-jet printing method of printing an image on a printing medium by driving print elements of a printhead and ejecting ink in accordance with an image signal, comprising:

a conveyance step of conveying the printing medium by an electrostatic chuck method;

a division step of dividing a timing of driving a plurality of print elements of the printhead, in accordance with an image signal, into a plurality of driving timings;

a selection step of selecting one of a plurality of print element groups, each group comprising a plurality of print elements of the printhead, wherein the print elements within each print element group are spaced apart from each other with a number of distance units between them, such that the number of distance units equals the number of groups, and wherein the size of the distance unit is defined to eliminate mutual influences of print elements driven at one driving timing, due to an electrostatic field generated in said conveyance step;

a driving step of energizing and driving the print element group selected in said selection step in accordance with the image signal at one of the plurality of driving timings;

a driving control step of selecting, after driving is performed in said driving step, a next print element group shifted by a predetermined amount from said one group, and driving the next print element group; and a control step of repeatedly driving in said driving control step until each of the plurality of print element groups has been selected in said selection step and driven at the plurality of driving timings.

6. The method according to claim 5, wherein the predetermined intervals correspond to the number (N) of the plurality of driving timings.

7. The method according to claim 6, wherein relative positions of the print element group driven at a given driving timing of the plurality of driving timings, and the print element group driven at the driving timing before/after the given driving timing, are shifted from each other by at least N/2 or (N/2-1).

8. The method according to claim 5, further comprising a block selection step of segmenting the plurality of print elements of the printhead into a plurality of blocks and selecting the print elements in units of blocks, and wherein in said driving step, the print element group selected in said selection step and the block selected by said block selection step are energized and driven, at one of the plurality of driving timings which are grouped into units equal in number to the plurality of blocks.

9. An ink-jet printer for printing an image on a printing medium by driving print elements of a full-line type of printhead and ejecting ink in accordance with an image signal, comprising:

conveyance means for conveying the printing medium by an electrostatic chuck method;

driving means for time-divisionally driving a plurality of groups of print elements, wherein a predetermined number of print elements are in each group; and driving control means for controlling such that a relative distance between print elements driven at successive timings is substantially ½ an interval between print elements driven by said driving means at a given timing, such that a deterioration in image quality due to a printed position offset by an electrostatic field from said conveyance means can be suppressed.

10. An ink-jet printing method of printing an image on a printing medium by driving print elements of a full line type of printhead and ejecting ink in accordance with an image signal, comprising:

a conveyance step of conveying the printing medium by an electrostatic chuck method;

a driving step of time-divisionally driving a plurality of groups of print elements, wherein a predetermined number of print elements are in each group; and a driving control step of controlling such that a relative distance between print elements driven at successive timings is substantially ½ an interval between print elements driven in said driving step at a given timing, such that a deterioration in image quality due to a printed position offset by an electrostatic field in said conveyance step can be suppressed.

* * * * *

UNITED STATES PATENT AND TRADEMARK OFFICE

CERTIFICATE OF CORRECTION

PATENT NO. : 6,705,691 B2
DATED : March 16, 2004
INVENTOR(S) : Toru Yamane et al.

It is certified that error appears in the above-identified patent and that said Letters Patent is hereby corrected as shown below:

Sheet 7,
FIGURE 7, “EIGHTH BLOCK” should read -- EIGHTH GROUP --.

Column 4,
Line 36, “ink 2010” should read -- nozzles 2010 --.

Column 8,
Line 39, “Ps for” should read ¶ -- for --;
Line 40, “$P$42.5x10$^{-6}$[m]” should read -- $P$=42.5x10$^{-6}$[m] --;
Line 55, “it is” should be deleted;
Line 56, “determined” should be deleted; and
Line 57, “driven in” should read -- driven are determined in --.

Column 9,
Line 7, “discharge” should read -- discharged --;
Line 21, “part” should read -- parts --; and
Line 49, “the” should be deleted.

Signed and Sealed this

Twenty-seventh Day of July, 2004

JON W. DUDAS
*Acting Director of the United States Patent and Trademark Office*